US010905154B2

(12) United States Patent
Sherwood et al.

(10) Patent No.: US 10,905,154 B2
(45) Date of Patent: Feb. 2, 2021

(54) ALTERNATING PATTERNS IN CIGARETTE WRAPPER, SMOKING ARTICLE AND METHOD

(75) Inventors: Timothy S. Sherwood, Midlothian, VA (US); Robert N. Smith, Glen Allen, VA (US); Marc W. Rose, Mechanicsville, VA (US); Tyrone W. Murray, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 1072 days.

(21) Appl. No.: 13/473,007

(22) Filed: May 16, 2012

(65) Prior Publication Data

US 2013/0087161 A1 Apr. 11, 2013

Related U.S. Application Data

(60) Provisional application No. 61/486,431, filed on May 16, 2011.

(51) Int. Cl.
*A24C 5/00* (2020.01)
*A24D 1/02* (2006.01)

(52) U.S. Cl.
CPC ..... *A24C 5/005* (2013.01); *A24D 1/025* (2013.01)

(58) Field of Classification Search
CPC ..... A24C 5/005; A24D 1/025
See application file for complete search history.

(56) References Cited

U.S. PATENT DOCUMENTS

| | | | |
|---|---|---|---|
| 1,555,320 | A | 9/1925 | Weil |
| 1,581,451 | A | 4/1926 | Knapp |
| 1,581,619 | A | 4/1926 | Sulzberger |
| 1,909,924 | A | 5/1933 | Schweitzer et al. |

(Continued)

FOREIGN PATENT DOCUMENTS

| | | | |
|---|---|---|---|
| BE | 779470 | A1 | 6/1972 |
| CA | 952656 | A1 | 8/1974 |

(Continued)

OTHER PUBLICATIONS

International Search Report and Written Opinion dated Jul. 27, 2012 for PCT/US2012/038123.

(Continued)

*Primary Examiner* — Michael H. Wilson
*Assistant Examiner* — Dionne W. Mayes
(74) *Attorney, Agent, or Firm* — Buchanan Ingersoll & Rooney PC

(57) ABSTRACT

A cigarette wrapper includes transversely extending banded regions applied by a printing technique, such as gravure printing. The banded regions may be applied in a one or more application of a printing composition that may be an aqueous starch solution also containing an anti-wrinkling agent such as propylene glycol, and calcium carbonate. The pattern of banded regions may be bands or stripes and the like along and/or around the tobacco rod. The banded regions may be solid or contain any number of cross-web and/or longitudinal discontinuities. The pattern may be configured so that when a smoking article is placed on a substrate, at least two longitudinal locations along the length of the tobacco rod have film-forming compound located only on sides of the smoking article not in contact with the substrate.

12 Claims, 12 Drawing Sheets

(56) References Cited

U.S. PATENT DOCUMENTS

| | | | |
|---|---|---|---|
| 1,996,002 | A | 3/1935 | Seaman |
| 1,999,222 | A | 4/1935 | Weinberger |
| 1,999,223 | A | 4/1935 | Weinberger |
| 1,999,224 | A | 4/1935 | Miles |
| 2,013,508 | A | 9/1935 | Seaman |
| 2,020,646 | A | 11/1935 | Hornstein |
| 2,022,004 | A | 11/1935 | Larson |
| 2,049,320 | A | 7/1936 | Ruben et al. |
| 2,098,619 | A | 11/1937 | Finnell |
| 2,149,896 | A | 3/1939 | McArdle et al. |
| 2,246,929 | A | 6/1941 | Seney |
| 2,307,088 | A | 1/1943 | Whiteley |
| 2,580,568 | A | 1/1952 | Matthews et al. |
| 2,580,608 | A | 1/1952 | Schur et al. |
| 2,666,437 | A | 1/1954 | Lattof |
| 2,718,889 | A | 9/1955 | Claussen |
| 2,733,720 | A | 2/1956 | Schur et al. |
| 2,754,207 | A | 7/1956 | Schur et al. |
| 2,886,042 | A | 5/1959 | Hoover et al. |
| 2,976,190 | A | 3/1961 | Meyer |
| 2,998,012 | A | 8/1961 | Lamm |
| 3,030,963 | A | 4/1962 | Cohn |
| 3,106,210 | A | 10/1963 | Reynolds |
| 3,370,593 | A | 2/1968 | Owaki |
| 3,395,714 | A | 8/1968 | Kahane |
| 3,409,021 | A | 11/1968 | Owaki |
| 3,477,440 | A | 11/1969 | Licis |
| 3,511,247 | A | 5/1970 | Tamol |
| 3,517,672 | A | 6/1970 | Michelson |
| 3,526,904 | A | 9/1970 | Tamol |
| 3,633,589 | A | 1/1972 | Kahane et al. |
| 3,640,285 | A | 2/1972 | Briskin et al. |
| 3,667,479 | A | 6/1972 | Sanford et al. |
| 3,699,973 | A | 10/1972 | Tamol et al. |
| 3,705,588 | A | 12/1972 | Tamol et al. |
| 3,722,515 | A | 3/1973 | Reynolds et al. |
| 3,782,393 | A | 1/1974 | Michelson |
| 3,805,799 | A | 4/1974 | Stewart, Jr. et al. |
| 3,903,899 | A | 9/1975 | Musillo |
| 3,908,671 | A | 9/1975 | Cogbill, II |
| 3,911,932 | A | 10/1975 | Houck, Jr. et al. |
| 4,020,850 | A | 5/1977 | Cogbill, II |
| 4,038,992 | A | 8/1977 | Ogasa et al. |
| 4,044,778 | A | 8/1977 | Cohn |
| 4,061,147 | A | 12/1977 | Falchi |
| 4,077,414 | A | 3/1978 | Baker et al. |
| 4,088,142 | A | 5/1978 | Horsewell et al. |
| 4,129,134 | A | 12/1978 | Hind et al. |
| 4,146,040 | A | 3/1979 | Cohn |
| 4,149,550 | A | 4/1979 | Green et al. |
| 4,187,862 | A | 2/1980 | Cohn |
| 4,193,409 | A | 3/1980 | Wahle et al. |
| 4,225,636 | A | 9/1980 | Cline et al. |
| 4,230,131 | A | 10/1980 | Simon |
| 4,231,377 | A | 11/1980 | Cline et al. |
| 4,236,532 | A | 12/1980 | Schweizer et al. |
| 4,239,591 | A | 12/1980 | Blake |
| 4,277,301 | A | 7/1981 | McIntyre et al. |
| 4,286,605 | A | 9/1981 | Goslin et al. |
| 4,295,478 | A | 10/1981 | Yeatts |
| 4,326,543 | A | 4/1982 | Martin et al. |
| 4,340,074 | A | 7/1982 | Tudor |
| 4,371,571 | A | 2/1983 | McIntyre et al. |
| 4,406,295 | A | 9/1983 | Sanford et al. |
| 4,411,279 | A | 10/1983 | Martin et al. |
| 4,453,553 | A | 1/1984 | Cohn |
| 4,450,847 | A | 5/1984 | Owens |
| 4,452,259 | A | 6/1984 | Norman et al. |
| 4,480,650 | A | 11/1984 | Weinert |
| 4,489,738 | A | 12/1984 | Simon |
| 4,590,955 | A | 5/1986 | Dixit |
| 4,607,647 | A | 8/1986 | Dashley et al. |
| 4,615,345 | A | 10/1986 | Durocher |
| 4,619,289 | A | 10/1986 | Smeed et al. |
| 4,622,983 | A | 11/1986 | Mathews et al. |
| 4,679,575 | A | 7/1987 | Yamaguchi et al. |
| 4,691,717 | A | 9/1987 | Ikeda et al. |
| 4,716,912 | A | 1/1988 | Leonard |
| 4,730,628 | A | 3/1988 | Townsend et al. |
| 4,739,775 | A | 4/1988 | Hampl, Jr. |
| 4,776,355 | A | 10/1988 | Stevenson et al. |
| 4,784,163 | A | 11/1988 | Adams et al. |
| 4,784,164 | A | 11/1988 | Adams et al. |
| 4,889,145 | A | 12/1989 | Adams et al. |
| 4,924,883 | A | 5/1990 | Perfetti et al. |
| 4,924,888 | A | 5/1990 | Perfetti et al. |
| 4,941,486 | A | 7/1990 | Dube et al. |
| 4,942,888 | A | 7/1990 | Montoya et al. |
| 4,945,932 | A | 8/1990 | Mentzel et al. |
| 4,998,542 | A | 3/1991 | Kallianos et al. |
| 4,998,543 | A | 3/1991 | Goodman et al. |
| 5,060,675 | A | 10/1991 | Milford et al. |
| 5,072,744 | A | 12/1991 | Luke et al. |
| 5,074,321 | A | 12/1991 | Gentry et al. |
| 5,085,228 | A | 2/1992 | Mooney et al. |
| 5,092,353 | A | 3/1992 | Montoya et al. |
| 5,094,253 | A | 3/1992 | St. Charles et al. |
| 5,101,839 | A | 4/1992 | Jakob et al. |
| 5,101,840 | A | 4/1992 | Riehl, Jr. |
| 5,103,844 | A | 4/1992 | Hayden et al. |
| 5,105,836 | A | 4/1992 | Gentry et al. |
| 5,105,838 | A | 4/1992 | White et al. |
| 5,107,866 | A | 4/1992 | Aronoff et al. |
| 5,109,876 | A | 5/1992 | Hayden et al. |
| 5,129,408 | A | 7/1992 | Jakob et al. |
| 5,143,098 | A | 9/1992 | Rogers et al. |
| 5,144,964 | A | 9/1992 | Demain |
| 5,144,966 | A | 9/1992 | Washington |
| 5,144,967 | A | 9/1992 | Cartwright et al. |
| 5,152,304 | A | 10/1992 | Bokelman et al. |
| 5,154,191 | A | 10/1992 | Owens, Jr. |
| 5,155,140 | A | 10/1992 | Marten et al. |
| 5,168,884 | A | 12/1992 | Baldwin et al. |
| 5,170,807 | A | 12/1992 | Kasbo et al. |
| 5,178,167 | A | 1/1993 | Riggs et al. |
| 5,191,906 | A | 3/1993 | Myracle, Jr. |
| 5,220,930 | A | 6/1993 | Gentry |
| 5,244,530 | A | 9/1993 | Collins et al. |
| 5,263,500 | A | 11/1993 | Baldwin et al. |
| 5,263,999 | A | 11/1993 | Baldwin et al. |
| 5,271,419 | A | 12/1993 | Arzonico et al. |
| 5,329,004 | A | 7/1994 | Eden et al. |
| 5,342,484 | A | 8/1994 | Cutright et al. |
| 5,345,950 | A | 9/1994 | Adebar et al. |
| 5,396,911 | A | 3/1995 | Casey, III et al. |
| 5,415,186 | A | 5/1995 | Casey, III et al. |
| 5,417,228 | A | 5/1995 | Baldwin et al. |
| 5,450,862 | A | 9/1995 | Baldwin et al. |
| 5,450,863 | A | 9/1995 | Collins et al. |
| 5,464,028 | A | 11/1995 | Takeda et al. |
| 5,465,739 | A | 11/1995 | Perfetti et al. |
| 5,474,095 | A | 12/1995 | Allen et al. |
| 5,490,875 | A | 2/1996 | Wermers et al. |
| 5,490,876 | A | 2/1996 | Warmerdam et al. |
| 5,492,568 | A | 2/1996 | Warmerdam et al. |
| 5,497,793 | A | 3/1996 | Kubica |
| 5,498,224 | A | 3/1996 | Kauffman et al. |
| 5,507,304 | A | 4/1996 | Maheras et al. |
| 5,523,036 | A | 6/1996 | Lake et al. |
| 5,529,619 | A | 6/1996 | Warmerdam et al. |
| 5,534,114 | A | 7/1996 | Cutright et al. |
| 5,538,018 | A | 7/1996 | Chan et al. |
| 5,538,019 | A | 7/1996 | Bullwinkel et al. |
| 5,540,242 | A | 7/1996 | Chao et al. |
| 5,589,034 | A | 12/1996 | Hultman et al. |
| 5,595,196 | A | 1/1997 | Salonen et al. |
| 5,598,868 | A | 2/1997 | Jakob et al. |
| 5,613,505 | A | 3/1997 | Campbell et al. |
| 5,641,349 | A | 6/1997 | Koubek et al. |
| 5,690,787 | A | 11/1997 | Hultman et al. |
| 5,702,555 | A | 12/1997 | Caudal et al. |
| 5,709,227 | A | 1/1998 | Arzonice et al. |
| 5,730,840 | A | 3/1998 | Hampl, Jr. et al. |
| 5,732,718 | A | 3/1998 | Douglas et al. |

(56) References Cited

U.S. PATENT DOCUMENTS

| | | | |
|---|---|---|---|
| 5,820,998 | A | 10/1998 | Hotaling et al. |
| 5,824,190 | A | 10/1998 | Guerro et al. |
| 5,830,318 | A | 11/1998 | Snow et al. |
| 5,878,753 | A | 3/1999 | Peterson et al. |
| 5,878,754 | A | 3/1999 | Peterson et al. |
| 5,888,348 | A | 3/1999 | Hampl, Jr. |
| 5,893,372 | A | 4/1999 | Hampl, Jr. |
| 5,911,224 | A | 6/1999 | Berger |
| 5,921,249 | A | 7/1999 | Hampl, Jr. |
| 5,974,732 | A | 11/1999 | Saito |
| 5,985,323 | A | 11/1999 | Augello et al. |
| 5,992,420 | A | 11/1999 | Moriyama |
| 5,997,691 | A | 12/1999 | Gautam et al. |
| 6,020,969 | A | 2/2000 | Struckhoff et al. |
| 6,095,152 | A | 8/2000 | Beven et al. |
| 6,129,087 | A | 10/2000 | Wallace et al. |
| 6,198,537 | B1 | 3/2001 | Bokelman et al. |
| 6,305,382 | B1 | 10/2001 | Hampl, Jr. |
| 6,397,852 | B1 | 6/2002 | McAdam |
| 6,568,403 | B2 | 5/2003 | Hampl, Jr. et al. |
| 6,584,981 | B2 | 7/2003 | Hampl, Jr. |
| 6,596,125 | B2 | 7/2003 | Garg et al. |
| 6,606,999 | B2 | 8/2003 | Crooks et al. |
| 6,645,605 | B2 | 11/2003 | Hammersmith et al. |
| 6,676,806 | B1 | 1/2004 | Butt |
| 6,705,325 | B1 | 3/2004 | Hicks et al. |
| 6,725,867 | B2 | 4/2004 | Peterson et al. |
| 6,779,530 | B2 | 8/2004 | Kraker |
| 6,779,531 | B1 | 8/2004 | Biggs et al. |
| 6,789,548 | B2 | 9/2004 | Bereman |
| 6,799,578 | B2 | 10/2004 | Snaidr et al. |
| 6,823,872 | B2 | 11/2004 | Hampl, Jr. |
| 6,837,248 | B2 | 1/2005 | Zawadzki et al. |
| 6,959,712 | B2 | 1/2005 | Bereman et al. |
| 6,929,013 | B2 | 8/2005 | Ashcraft et al. |
| 6,976,493 | B2 | 12/2005 | Chapman et al. |
| 6,997,190 | B2 | 2/2006 | Stokes et al. |
| 7,047,982 | B2 | 5/2006 | Seymour et al. |
| 7,073,514 | B2 | 7/2006 | Barnes et al. |
| 7,077,145 | B2 | 7/2006 | Seymour et al. |
| 7,115,085 | B2 | 10/2006 | Deal |
| 7,116,750 | B1 | 10/2006 | Iaquinta et al. |
| 7,117,871 | B2 | 10/2006 | Hancock et al. |
| 7,195,019 | B2 | 3/2007 | Hancock et al. |
| 7,234,471 | B2 | 6/2007 | Fitzgerald et al. |
| 7,237,558 | B2 | 7/2007 | Clark et al. |
| 7,237,559 | B2 | 7/2007 | Ashcraft et al. |
| 7,240,678 | B2 | 7/2007 | Crooks |
| 7,275,548 | B2 | 10/2007 | Hancock et al. |
| 7,275,549 | B2 | 10/2007 | Hancock et al. |
| 7,276,120 | B2 | 10/2007 | Holmes |
| 7,281,540 | B2 | 10/2007 | Barnes et al. |
| 7,290,549 | B2 | 11/2007 | Banerjee et al. |
| 7,296,578 | B2 | 11/2007 | Read, Jr. |
| 7,363,929 | B2 | 4/2008 | Fagg et al. |
| 2002/0179105 | A1 | 12/2002 | Zawadzki et al. |
| 2002/0179106 | A1 | 12/2002 | Zawadzki et al. |
| 2003/0131860 | A1 | 7/2003 | Ashcraft et al. |
| 2003/0136420 | A1 | 7/2003 | Kraker |
| 2003/0145869 | A1 | 8/2003 | Kitao et al. |
| 2003/0217757 | A1 | 11/2003 | Edelmann |
| 2004/0025894 | A1 | 2/2004 | Beven et al. |
| 2004/0074508 | A1 | 4/2004 | McAdam et al. |
| 2004/0099280 | A1 | 5/2004 | Stokes et al. |
| 2004/0122547 | A1 | 6/2004 | Seymour et al. |
| 2004/0123874 | A1 | 7/2004 | Zawadzki et al. |
| 2004/0129281 | A1 | 7/2004 | Hancock et al. |
| 2004/0134631 | A1 | 7/2004 | Crooks et al. |
| 2004/0168695 | A1 | 9/2004 | Snaidr et al. |
| 2004/0173229 | A1 | 9/2004 | Crooks et al. |
| 2004/0182407 | A1 | 9/2004 | Peterson et al. |
| 2004/0231685 | A1 | 11/2004 | Patel et al. |
| 2004/0237978 | A1 | 12/2004 | Barnes et al. |
| 2004/0238136 | A1 | 12/2004 | Patel et al. |
| 2004/0255966 | A1 | 12/2004 | Kraker |
| 2004/0261805 | A1 | 12/2004 | Wanna et al. |
| 2005/0000528 | A1 | 1/2005 | Bereman |
| 2005/0000529 | A1 | 1/2005 | Bereman et al. |
| 2005/0000531 | A1 | 1/2005 | Shi |
| 2005/0005947 | A1 | 1/2005 | Hampl et al. |
| 2005/0016556 | A1 | 1/2005 | Ashcraft et al. |
| 2005/0022833 | A1 | 2/2005 | Gedevanishvili et al. |
| 2005/0039767 | A1 | 2/2005 | Mua et al. |
| 2005/0051185 | A1 | 3/2005 | Rasouli et al. |
| 2005/0056293 | A1 | 3/2005 | Zawadzki et al. |
| 2005/0056294 | A1 | 3/2005 | Wanna et al. |
| 2005/0066980 | A1 | 3/2005 | Crooks et al. |
| 2005/0066982 | A1 | 3/2005 | Clark et al. |
| 2005/0066984 | A1 | 3/2005 | Crooks et al. |
| 2005/0076925 | A1 | 4/2005 | Fagg et al. |
| 2005/0076929 | A1 | 4/2005 | Fitzgerald et al. |
| 2005/0081869 | A1 | 4/2005 | Biggs et al. |
| 2005/0087202 | A1 | 4/2005 | Norman et al. |
| 2005/0103355 | A1 | 5/2005 | Holmes |
| 2005/0115575 | A1 | 6/2005 | Seymour et al. |
| 2005/0115579 | A1 | 6/2005 | Beven et al. |
| 2005/0166936 | A1 | 8/2005 | Snaidr |
| 2005/0172977 | A1 | 8/2005 | Jadot et al. |
| 2005/0178399 | A1 | 8/2005 | Shafer et al. |
| 2005/0211259 | A1 | 9/2005 | Gedevanishvili |
| 2005/0241659 | A1 | 11/2005 | Ray et al. |
| 2005/0241660 | A1 | 11/2005 | Ashcraft et al. |
| 2006/0005847 | A1 | 1/2006 | Chapman et al. |
| 2006/0011207 | A1 | 1/2006 | Chapman et al. |
| 2006/0124146 | A1 | 1/2006 | Stokes et al. |
| 2006/0021625 | A1 | 2/2006 | Nyffeler |
| 2006/0021626 | A1 | 2/2006 | Mua |
| 2006/0037621 | A1 | 2/2006 | Bereman et al. |
| 2006/0174904 | A1 | 8/2006 | Wanna |
| 2006/0207617 | A1 | 9/2006 | Seymour et al. |
| 2006/0231114 | A1 | 10/2006 | Oglesby et al. |
| 2006/0237024 | A1 | 10/2006 | Reich et al. |
| 2006/0243290 | A1 | 11/2006 | Reich et al. |
| 2007/0029060 | A1 | 2/2007 | Murray et al. |
| 2007/0051381 | A1 | 3/2007 | Hancock et al. |
| 2007/0056600 | A1 | 3/2007 | Coleman et al. |
| 2007/0084475 | A1 | 4/2007 | Oglesby et al. |
| 2007/0095357 | A1 | 5/2007 | Besso et al. |
| 2007/0095358 | A1* | 5/2007 | Li et al. ..... A24D 1/025 131/365 |
| 2007/0102017 | A1 | 5/2007 | Sherwood et al. |
| 2007/0137668 | A1 | 6/2007 | Borschke et al. |
| 2007/0144545 | A1 | 6/2007 | Long et al. |
| 2007/0157940 | A1 | 7/2007 | Mua et al. |
| 2007/0169786 | A1 | 7/2007 | Li et al. |
| 2007/0175058 | A1 | 8/2007 | Bengi |
| 2007/0295348 | A1 | 12/2007 | Wann |
| 2008/0011312 | A1 | 1/2008 | Matsufuji et al. |
| 2008/0295854 | A1 | 12/2008 | Li et al. |
| 2011/0108042 | A1 | 5/2011 | Sherwood et al. |
| 2011/0155158 | A1 | 6/2011 | Li et al. |
| 2011/0297168 | A1 | 12/2011 | Li et al. |
| 2011/0297169 | A1 | 12/2011 | Li et al. |
| 2011/0297736 | A1 | 12/2011 | Li et al. |
| 2011/0300299 | A1 | 12/2011 | Li et al. |
| 2011/0303233 | A1 | 12/2011 | Li et al. |
| 2012/0031417 | A1 | 2/2012 | Li et al. |

FOREIGN PATENT DOCUMENTS

| | | | |
|---|---|---|---|
| FR | 2136767 | A5 | 12/1972 |
| JP | H0633400 | A | 2/1994 |
| JP | H10151722 | A | 6/1998 |
| JP | 2009531056 | A | 9/2009 |
| JP | 2010/527600 | A | 8/2010 |
| JP | 2010/527601 | A | 8/2010 |
| JP | 2010/537628 | A | 12/2010 |
| JP | 2010537628 | A | 12/2010 |
| JP | 2011/069040 | A | 4/2011 |
| WO | WO 02/37991 | A1 | 5/2002 |
| WO | WO 03/088771 | A1 | 10/2003 |
| WO | WO 2005/002370D3 | | 1/2005 |
| WO | WO 2006/004343 | A1 | 1/2006 |
| WO | WO 2007/020532 | A1 | 2/2007 |

(56) References Cited

FOREIGN PATENT DOCUMENTS

| | | | |
|---|---|---|---|
| WO | WO 2007/031965 | A2 | 3/2007 |
| WO | WO 2007/113693 | A2 | 10/2007 |
| WO | WO 2008/146158 | A2 | 12/2008 |
| WO | WO 2008/149241 | A2 | 12/2008 |
| WO | WO 2009/004482 | A2 | 1/2009 |
| WO | WO 2011/012220 | A1 | 2/2011 |

OTHER PUBLICATIONS

European Supplementary Search Report dated Apr. 28, 2015 for EP 12785600.3.

Chapman, Simon et al., "Reduction-Ignition Propensity Cigarettes," Aug. 25, 2004, XP55006441, http://www.health.gov.au/internet/main/publishing.nsf/Content/1526AD854C903649CA256F8E0011ACBE/$File/smoking_rip.pdf [retrieved on Sep. 7, 2011].

Glogan, T., "Making fire-safe cigarettes a hot topic", Tobacco Journal International, vol. 2004, No. 2, Mar. 1, 2004, pp. 64-65.

Norman, Alan B. et al., "Measurement of Gas Diffusion Capacity of Cigarette Papers", Beiträge zur Tabakforschung International/Contributions to Tobacco Research, vol. 21, No. 8, pp. 425-434; Dec. 2005.

Rossel, Stefanie, "Canada's burning issue", Tobacco Journal International, vol. 2005, No. 4, Aug. 1, 2005, pp. 88-91, XP002562192.

"Standard Test Method for Measuring the Ignition Strength of Cigarettes", ASTM International, Designation E2187-4, pp. 1-8, published Aug. 2004.

"Standard Test Method for Measuring the Ignition Strength of Cigarettes", ASTM International, Designation E2187-09, pp. 1-8, published Jan. 2010.

Commonly Owned U.S. Appl.. No. 13/324,747, filed Dec. 13, 2011.

Commonly Owned U.S. Appl. No. 61/064,439, filed Mar. 8, 2009.

Notification of Reasons for Refusal with English translation corresponding to Japanese Patent Application No. 2014-511489, dated Feb. 16, 2016; (14 pages).

Office Action dated Dec. 5, 2017 in corresponding Japanese Patent Application No. 2016-234459, 6 pages.

* cited by examiner

ALTERNATING PATTERNS IN CIGARETTE WRAPPER, SMOKING ARTICLE AND METHOD

CROSS-REFERENCE TO RELATED APPLICATION

This non-provisional patent application claims priority under 35 U.S.C. 119, and 37 C.F.R. 1.55 based on U.S. Provisional Application Ser. No. 61/486,431, filed May 16, 2011, the entire content of which is incorporated herein by this reference thereto.

FIELD OF THE DISCLOSURE

This disclosure relates generally to a smoking article and, more particularly, a patterned wrapper for use in cigarette manufacturing, related materials, processes, and methods for making them. The patterned wrapper includes first pattern elements having a first IP performance, and second pattern elements having a second IP performance, where the first and second pattern elements alternate. Wrappers and smoking articles exhibit a low ignition propensity and/or low self-extinguishment characteristics. Various other configurations for patterned regions are contemplated and described.

Ignition Propensity ("IP")

Ignition Propensity or IP is a standard test conducted as set forth in ASTM E 2187-04, "Standard Test Method for Measuring the Ignition Strength of Smoking articles", which is incorporated herein in its entirety by this reference thereto. Ignition propensity measures the probability that a smoking article, when smoldering and placed on a substrate, will generate sufficient heat to maintain smoldering of the tobacco rod. Low values for IP are desirable as such values correlate with a reduced likelihood that a smoldering smoking article, when inadvertently left unattended upon a substrate, will cause combustion in the substrate.

Self-Extinguishment ("SE")

Self-Extinguishment or SE herein is a reference to smoldering characteristics of a smoking article under free burn conditions. To evaluate SE, a laboratory test is conducted at a temperature of 23° C.±3° C. and relative humidity of 55%±5%, both of which should be monitored by a recording hygrothermograph. Exhaust hood(s) remove combustion products formed during testing. Prior to testing, smoking articles to be tested are conditioned at 55%±5% relative humidity and 23° c.±3° C. for 24 hours. Just prior to testing, the smoking articles are placed in glass beakers to assure free air access.

SE testing takes place within an enclosure or test box. A single port smoking machine and an electric lighter are used to ignite the smoking articles for the test. During testing, an apparatus or "angle holder" holds the smoking articles to be tested by holding the mouth-end at angles of 0° (horizontal), 45°, and/or 90° (vertical). Preferably, twenty (20) smoking articles are tested at each of the 0°, 45°, and 90° positions. If more than one apparatus is used, the apparatuses are preferably positioned such that the smoking articles face away from each other to avoid cross interference. If a smoking article goes out before the front line of the smoldering coal reaches the tipping paper, the outcome is scored as "self-extinguishment"; on the other hand, if the smoking article continues smoldering until the front line of the smoldering coal reaches the tipping paper, then the outcome is scored as "non-extinguishment". Thus, for example, an SE value of 95% indicates that 95% of the smoking articles tested exhibited self-extinguishment under free burn conditions; while an SE value of 20% indicates that only 20% of the smoking articles tested exhibited self-extinguishment under such free burn conditions.

The SE value may be referred to in terms of "Self-Extinction at 0° value", "Self-Extinction at 45° value", or "Self-Extinction at 90° value", each of which refers to the value of SE at the specified tested angle. In addition, the SE value may be referred to in terms of "Self-Extinction Average value", which refers to an average of the three angular positions: namely, an average of (i) the "Self-Extinction at 0° value", (ii) the "Self-Extinction at 45° value", and (iii) the "Self-Extinction at 90° value". A reference to "Self-Extinction value" or "SE value" does not distinguish between SE at 0°, SE at 45°, SE at 90°, or SE average values and may refer to any one of them.

To meet current regulatory requirements, the Ignition Propensity value, or IP value, for a smoking article should preferably be no greater than about 25%. Cigarettes exhibiting a 0% IP value meet and exceed current regulatory IP performance requirements, but suffer higher SE values. The average Self-Extinction Average value for a smoking article should preferably be no greater than about 50%, and more preferably no greater than about 25%, or less.

SUMMARY

Embodiments herein disclosed include patterned and banded papers and smoking articles constructed from such papers, wherein the add-on material comprises an aqueous starch solution (or system) that includes an anti-wrinkling agent as disclosed herein, as well as chalk as disclosed herein, applied in alternating first and second pattern elements such that the following are achievable:

- adjacent pattern elements having improved, but different IP characteristics;
- alternate pattern elements are capable of providing IP values of less than 25%;
- regulatory IP performance criteria are satisfied while SE performance is improved.

In addition there are teachings herein of embodiments that include patterned and/or banded papers and smoking articles constructed from such papers, wherein the add-on material comprises an aqueous, preferably starch solution that includes a chalk content sufficient to abate the tendency of the banded paper to cause self-extinguishments and to enhance appearance of the product to a consumer.

Furthermore, there are teachings herein of embodiments that include patterned and/or banded papers and smoking articles constructed from such papers, wherein the bands are established according to patterns which help abate the statistical occurrences of self-extinguishments (SE) while maintaining desired IP performance.

In accordance with one aspect, this disclosure involves a method of making or preparing a patterned wrapper paper by establishing a supply of an aqueous starch solution incorporating an anti-wrinkling agent and chalk to a printing station through which a base web is passed so that alternating first and second pattern elements can be applied in a single step using the aqueous starch solution.

In another aspect of this disclosure, a wrapper paper for a smoking article may have a base web to which add-on material is applied in a pattern using an aqueous starch solution that includes an anti-wrinkling agent and chalk. The aqueous starch solution may include starch at at least about 25% by weight, an anti-wrinkling agent between an effective amount and less than about 35% by weight of starch, and chalk or calcium carbonate between about 30% to about 80% by weight of starch.

In accordance with another aspect of this disclosure, a smoking article may include tobacco and a wrapper paper where the wrapper paper includes alternating first and second pattern elements of add-on material applied as an aqueous starch solution containing an anti-wrinkling agent and chalk, where adjacent pattern areas have reduced, but different, IP performance.

Further aspects of this disclosure involve, without limitation, patterns for the add-on material, characteristics of the constituents of the add-on material. Further, the disclosure relates to resulting features of the smoking article including without limitation ignition propensity and self-extinction characteristics.

BRIEF DESCRIPTION OF THE DRAWINGS

Many objects and advantages of the present disclosure will be apparent to those skilled in the art when this specification is read in conjunction with the accompanying drawings, wherein like reference numerals are applied to like elements and wherein.

BACKGROUND DEFINITIONS

Figure 1:
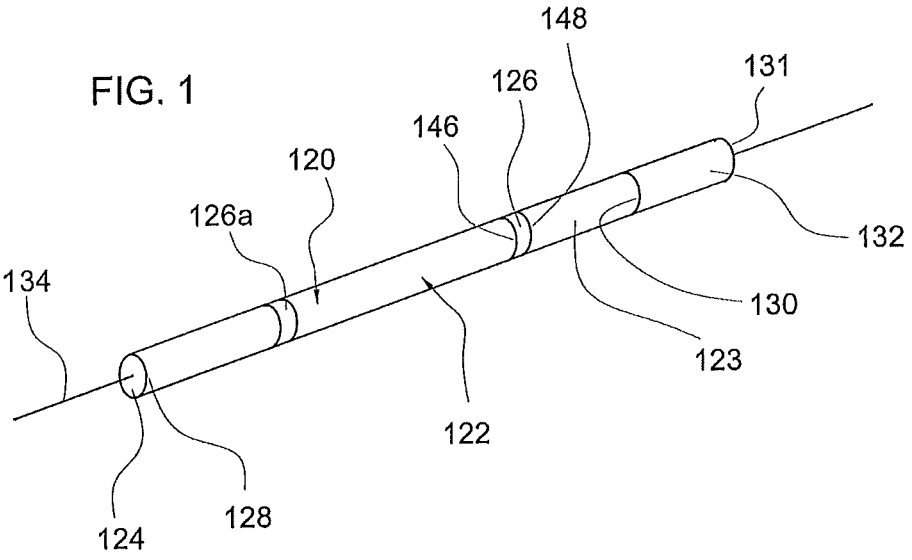
FIG. 1 is a schematic perspective view of a smoking article according to this disclosure.

Referring to FIG. 1, this disclosure concerns a smoking article 120, such as a cigarette, which preferably comprises a tobacco rod 122 and a filter 132 attached to one end of the tobacco rod 122 with tipping paper 132. Preferably, the tobacco rod 122 comprises a column of shredded tobacco ("cut filler") and a wrapper 123 disposed about the column of tobacco, which wrapper 123 is constructed in accordance with teachings which follow. The tobacco rod 122 has a lightable or lit end 124 and a tipped end 130 (which in the case of non-filtered cigarettes, is referenced as the mouth end 130 of the cigarette 120). Cut filler tobacco is an industry-standard designation. Further, the tobacco rod 122 typically has a generally circular cross section, although other oval cross sections and other non-circular shapes are within the scope of this disclosure. The wrapper is sealed along a longitudinal seam to form the tobacco rod 122.

The tobacco rod has a nominal length measured from the edge 131 of the tipping paper to the free end of the tobacco rod along a longitudinal axis of smoking article. By way of example, that nominal length may lie in the range of about 60 to about 100 mm.

The "wrapper" paper 123 (see FIG. 2) typically includes a "base web" 140 that may be made from flax, wood pulp, cellulose fiber, or the like, and may have a plurality of patterned and/or banded regions 126, **126*a* applied to one or both sides. Preferably, the patterned and/or banded region 126, 126*a* is applied to the inside of the wrapper 123 in the sense of how the wrapper 123 surrounds a column of tobacco in the tobacco rod 122**.

In the manufacture of base web suited for the construction of the various embodiments of print patterned and/or banded paper disclosed herein, such manufacture usually will include the production of a roll of base web of several feet across (usually about 3 feet across or in transverse dimension), which is then slit into bobbins. Printing operations are preferably conducted on the rolls, but could be conducted after slitting. Preferably, the bobbins themselves will have a transverse dimension equivalent to the width needed to make tobacco rods 122 or an integral number of such widths (e.g., 1, 2, or 4 of such widths). The bobbins are adapted for use with typical cigarette making machines. The wrapper preferably has a dimension in cross-direction that takes into account the nominal circumference of the tobacco rod and an overlapping seam. As a result, when the wrapper is slit, the smoking article formed therefrom always has a longitudinal seam with an exact overlap.

For purposes of this disclosure, "longitudinal" refers to the direction along the length of a tobacco rod (e.g., along the axis 134 in FIG. 1), or along the length of a base web 140 (e.g., arrow 142 in FIG. 2) used in the preparation of wrapper that, in turn, may be used to fabricate a tobacco rod.

For purposes of this disclosure, "transverse" refers to the direction circumferentially around a tobacco rod 122 (see FIG. 1), or transversely of a base web 140 (e.g., arrow 144 in FIG. 2) used in the preparation of wrapper that, in turn, may be used to fabricate a tobacco rod.

For purposes of this disclosure, a "banded region" or "zone" is an area 126, **126*a* (see FIG. 2) on an underlying base web 140 to which an add-on material has been applied. The patterned and/or banded region typically exhibits a two-dimensional pattern or array on the base web 140. More specifically, the pattern or array may comprise repeating units in the longitudinal direction 142 of the base web 140, repeating units in the transverse direction 144 of the base web 123, and or units which repeat in both the transverse 144 and longitudinal 142 directions of the base web 140. The regions 126, 126*a* of add-on material are applied to the wrapper 123** to obtain satisfactory or improved Ignition Propensity ("IP") characteristics and may also obtain improved Self-Extinguishment ("SE") characteristics.

The regions 126, 126*a* of add-on material are spaced along the base web 140 such that at least one region of add-on material 126, 126*a* is positioned between the first and second ends 128, 130 of the tobacco rod 122 in each finished smoking article, but more preferably at least two regions of add-on material may appear on the tobacco rod 122. The region 126, 126*a* of add-on material preferably extends in the circumferential direction at one or more spaced locations along the axis 134, extending around the tobacco rod 122 of the smoking article 120. While the region 126, 126*a* of add-on material is depicted in this disclosure as containing discontinuities in its circumferential direction, other configurations for the add-on material are within the spirit and scope of this disclosure, including, but not limited to, configurations where the add-on material is substantially continuous.

It is noted for sake of convention that, in describing dimensions of various embodiments herein, that band or zone "width" extends in a longitudinal direction 134 (see FIG. 1) of the tobacco rod 122, whereas a dimension in the circumferential direction will be expressed as "circumferential" or "transverse" or "in cross-direction."

Where the patterned and/or banded region 126, 126*a* extends transversely of the base web 140 (or circumferentially around a tobacco rod), the "width" of the patterned and/or banded region 126, 126*a* is measured in the longitudinal direction 142 from the leading edge 146 to the trailing edge 148 and is preferably lies in the range of from about 5 to about 9 mm (from the leading edge 146 to the trailing edge 148), more preferably from about 5 to about 7 mm, and even more preferably from about 6 to about 7 mm. Further, patterned and/or banded regions may have a 27 mm "phase" (i.e., the spacing from the leading edge 146 of one patterned and/or banded region 126, 126*a* to the leading edge 146 of the next adjacent patterned and/or banded region 126, 126*a*). Preferably, the patterned and/or banded regions of add-on material reduce permeability of the wrapper to the range of from about 0 to about 12 CORESTA.

For purposes of this disclosure, "band spacing" refers to the distance between the trailing edge 148 of one patterned and/or banded region 126, 126*a* and the leading edge 146 of an adjacent patterned and/or banded region 126,126*a* on the base web 140 from which a wrapper is fashioned.

As used herein, the phrase "leading edge" refers to the edge 146 (see FIG. 1) of a patterned and/or banded region 126, 126*a* that is closest to an approaching coal during smoldering of a smoking article 120 whose wrapper 123 contains the patterned and/or banded region 126, 126*a*, while the phrase "trailing edge" refers to the edge 148 of a patterned and/or banded region 126, 126*a* that is farthest from an approaching coal during smoldering of a smoking article 120 whose wrapper 123 contains the patterned and/or banded region 126, 126*a*.

For purposes of this disclosure, "layer" refers to a quantity of add-on material applied to a base web from which a wrapper is fabricated. Each patterned and/or banded region 126, 126*a* may be formed by applying a "layer" of an aqueous film-forming composition to the base web 140 of the wrapper to reduce the permeability of the paper in the corresponding patterned and/or banded region.

Where a film-forming composition is used, that "film-forming composition" preferably may include water and a high concentration of an occluding agent, e.g., 14% to about 50% by weight. The film-forming compound can include one or more occluding agents such as starch, alginate, cellulose or gum and may also include calcium carbonate as a filler. Further, the film-forming composition preferably includes an anti-wrinkling agent. Where starch is the film-forming compound, a concentration of at least about 25% may be particularly advantageous, and a concentration of about 30% is presently most preferred.

Other add-on formulations (or compositions) may be used in lieu of or in combination with the aforementioned, including those comprising solvent-based formulations or refined cellulosic compositions.

An "anti-wrinkling agent" is a material which inhibits transverse shrinkage of the base web 140 (see FIG. 2) during printing or other conversion operations. A suitable anti-wrinkling agent may be selected from the group consisting of 1,2 propylene glycol, propylene glycol, glycerin, and starch plasticizing agents. Teachings regarding inclusion of an "anti-wrinkling agent" are provided in pending published patent application U.S. Patent Application Publication 2008/0295854, and U.S. patent application Ser. No. 13/324,747, the contents of which are incorporated herein by this reference thereto.

The film-forming composition may be applied to the base web of the wrapper 140 using conversion technologies such as gravure printing, digital printing, coating or spraying using a template, or any other suitable technique.

When discussing application rates for add-on material applied using gravure printing techniques, often use values with "X" as a suffix to refer to a volumetric application rate. The table below sets out the volumetric equivalents for "X" in terms of billion cubic microns per square inch, or "BCM":

| Volume | BCM |
|---|---|
| 0.5X | 3.4 |
| 1.0X | 4.6 |
| 1.5X | 6.8 |
| 2.0X | 10 |
| 2.5X | 10.7 |
| 3.0X | 12.3 |
| 3.5X | 13.6 |
| 4.0X | 17.8 |
| 4.5X | 19.9 |
| 5.0X | 22.4 |
| 5.5X | 24.7 |
| 6.0X | 27.8 |

When the phrase "weight ratio" is used herein with respect to the starch component of a starch solution, the "weight ratio" is the ratio of the weight of the additional material compared to the weight of starch used to prepare the starch solution. Moreover, for purposes of this disclosure, references to an "X % starch solution" refer to an aqueous starch solution in which the starch weight is X % of the solution weight (e.g., weight of starch divided by the sum of starch weight and aqueous component weight).

The wrapper includes a base web which typically is permeable to air. Permeability of wrapper is typically identified in CORESTA units. A CORESTA unit measures paper permeability in terms of volumetric flow rate (i.e., $cm^3$/sec) per unit area (i.e., $cm^2$) per unit pressure drop (i.e., cm of water). The base web of conventional wrapper also has well-known basis weights, measured in grams per square meter, abbreviated as "gsm". The permeability and basis weight for the base web of typical smoking article papers commonly used in the industry are set out in the table below:

| Permeability, CORESTA units | Basis Weight, gsm |
|---|---|
| 24 | 25 |
| 33 | 25 |
| 46 | 25 |
| 60 | 26-27 |

For purposes of this description, the base web of a preferred wrapper has a permeability of at least about 20 CORESTA units. Most preferably, the wrapper has a permeability greater than about 30 CORESTA, such as common base webs having nominal permeabilities of about 33 and about 46 CORESTA with a basis weight of about 25 gsm. For some applications, the base web may have a permeability of greater than about 60 CORESTA, or greater than about 80 CORESTA, or even higher permeability values.

Schematic vs. Actual Depictions

Figure 6:
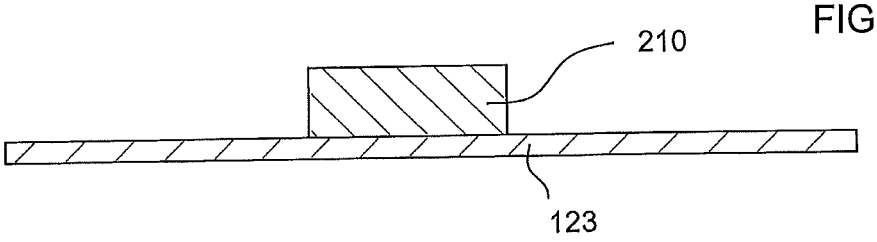
FIG. 6 is an enlarged schematic cross-sectional view taken along the line 6-6 of FIG. 2.

Depictions of cross sections taken through a patterned and/or banded paper, such as FIG. 6, are believed to be useful schematic representations of a paper web having patterned and/or banded regions fashioned from a single application, and of the application processes by which such patterned and/or banded papers are fabricated. However, such schematic representations do not accurately depict the reality of the cross-section base web structures, or the reality of the cross-section of base web structures to which a layer of add-on material has been applied, or the reality of the cross-section of the layer of add-on material, in the final patterned and/or banded paper product.

Real world results of applying one or more layers of add-on material to a base web 140 have significant variance from schematic representations of layers applied to a web. Accordingly, while the schematic representations of add-on layers fairly show the process application rates, and might be used as a guide to etch application zones of a gravure print cylinder or the like, those schematic representations do not accurately represent the structure of the finished wrapper prepared by applying one layer of add-on material to a base web. Further details of the cross-sectional structure of a wrapper with material printed thereon may be found in U.S. Patent Application Publication 2008/0295854, which is incorporated herein in its entirety by this reference thereto.

An Illustrative Embodiment—Solid Band Pattern

Figure 2:
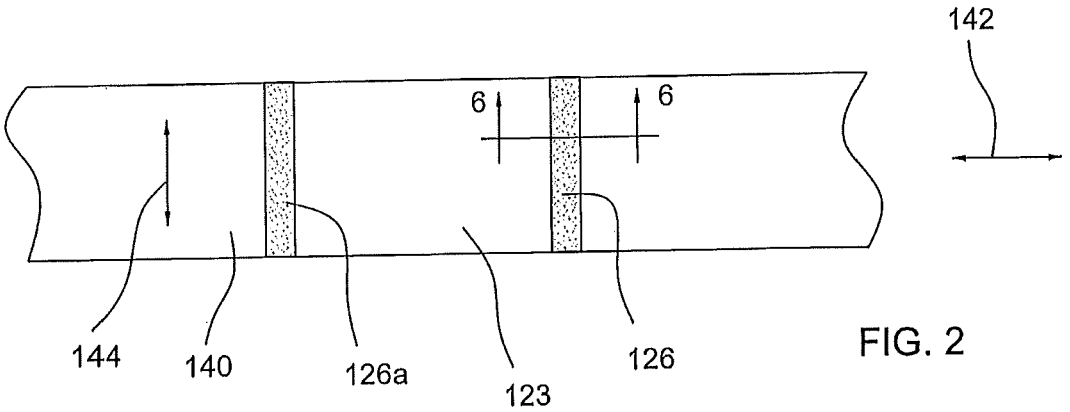
FIG. 2 is a schematic view of a wrapper paper according to this disclosure.

Referring now to FIG. 2, a wrapper for a smoking article is prepared by applying a pattern 126, 126*a* of add-on material to a base web 140. The add-on material preferably comprises an aqueous starch solution having a starch in the range of about 25% to about 35% by weight. In addition, the add-on material preferably includes chalk (i.e., calcium carbonate) in the range of about 60% to about 80% as well as an anti-wrinkling agent in the range of about 10% to about 30%, where the percentages of chalk and the anti-wrinkling agent are percentages of the weight of starch used in the aqueous solution.

In a presently preferred embodiment the add-on material is applied to the base web 140 in a substantially continuous, transversely extending, solid band 126, 126*a* by a printing step and dried to remove moisture from the add-on material. That printing step may be a single printing step, two or more sequential printing steps, a gravure printing operation, a flexographic printing operation, a cellulosic deposition process, and/or the like. That is, the printing concept is one of applying a printing composition to the web, and the specific application or printing mechanism is not intended to limit the generality of the process. Preferably, the band 126 and the band 126*a* alternate along the longitudinal direction of the base web 140. The band 126 is preferably applied to the base web 140 such that the resulting transverse band is effective to provide an IP performance of 0%. The band 126*a* is preferably applied to the base web 140 such that the resulting transverse band allows a greater IP performance than the band 126. Preferably, the IP performance of the band 126*a* in combination with the band 126 is less than about 25%. Most preferably, the IP performance of the band 126*a* also is less than about 25%. In any event, the band 126 and the band 126*a* are nominally the same both in terms of geometry on the base web and in terms of meeting IP performance requirements (currently at or less than 25% IP value).

The add-on material may be applied to the base web 140 by, for example, a gravure printing process or a moving orifice device. Moving orifice devices are described in more detail in commonly assigned U.S. Pat. Nos. 5,534,114 and 5,997,691, both of which are incorporated herein by this reference thereto. To effect parallel banded regions with alternative IP performance using a moving orifice device, the nominal diameter of alternating orifices may be different in an alternating pattern so that banded regions receive alternating amounts of add-on material.

Where a gravure process is used, the gravure roll may, for example, have an axial length of about 50 inches so as to be able to print bands having a transverse width of about 50 inches. The gravure roll preferably has circumferentially spaced regions having cells to receive the add-on solution for transfer to the base web. Those spaced regions preferably have a width measured in the circumferential direction of the gravure roll corresponding to the desired width of the bands in the resulting wrapper. Moreover, those spaced regions are further spaced circumferentially from one another by a distance corresponding to the pitch of the banded regions in the resulting wrapper.

Within each spaced region, the gravure roll is provided with a plurality of intercalated generally hexagonal cells. The hexagonal cells may be arranged at about 85 lines per inch. When using a base web having a porosity of 33 or 46 CORESTA units, each hexagonal cell may have a depth of about 48 to about 52 μm (micrometer), and preferably about 50 μm. Adjacent hexagonal cells are typically spaced about 10 to about 14 μm from one another, and have downwardly inclined sidewalls at an angle of about 60° relative to the surface of the gravure roller. The resulting hexagonal cell has an opening of about 285 to about 295 μm. Where the permeability of the base web is on the order of 60 CORESTA units, the depth of the hexagonal cells may be about 60 μm. To attain the alternating IP performance of adjacent bands 126, 126*a*, the depth of the corresponding cells in the gravure roll may be appropriately adjusted. Alternatively, the width of the adjacent bands 126, 126*a* may be adjusted to vary the rate at which add-on material is applied by the gravure roll. Still further, a combination of cell depth and band width may be used to effect the alternating band IP performance. Yet further, the spacing between hexagonal cells of the adjacent bands may be varied. Other equivalent mechanisms may also be within the skill of the art Those of ordinary skill in the art will appreciate that the hexagonal cells of the gravure roller may be fabricated using known processes including, for example, etching.

The resulting wrapper is then used to construct a smoking article 120 (see FIG. 1). The smoking article 120 typically includes a tobacco rod 122 having a wrapper 123 surrounding a quantity of cut filler tobacco 124. A suitable filter 132 may be provided at one end of the tobacco rod 122. Using wrapper as described above, the tobacco rod 122 (and thus the smoking article 120) exhibits a substantially solid banded arrangement of add-on material where the bands 126, 126*a* extend circumferentially around the tobacco rod 122 and have a band width (measured in the direction of the axis 134) in the range of about 6 to about 7 mm, preferably about 7 mm.

With inclusion of the anti-wrinkling agent, such as 1,2 propylene glycol, in this embodiment as described, one may achieve the associated advantages detailed further in the description which follows, but specifically including:

- providing a countermeasure against a tendency of an aqueous solution to create wrinkles and/or creases in the wrapper;
- permitting printing of intricate patterns on a base web in a single application using aqueous add-on systems at commercially viable printing speeds; and/or
- providing add-on solution stability, including a longer operational shelf-life, which reduces costs and waste during printing operations.

With inclusion of the chalk in this embodiment as described, one may abate the tendency of the patterned and/or banded paper cigarettes to self-extinguish, enhance appearance of the product to a consumer and achieve these and other associated advantages summarized above and detailed further in the description which follows.

It is also to be appreciated that with the solid band construction as described in reference to FIG. 1 one obtains a wrapper which is capable of contributing a desirable IP performance to the smoking article i.e., no greater than 25%, and which may include in various applications, an IP performance of less than 25%.

Difficulties Encountered with Applying Aqueous, Preferably Starch, Add-on Solutions There are advantages with the concept of using aqueous starch solutions as add-on material for making patterned and/or banded wrapper to control IP characteristics of smoking articles manufactured using such patterned and/or banded wrapper. However, the application of aqueous starch solutions to a base web creates difficulties For example, aqueous starch solutions have a tendency to penetrate the irregular, rough, and porous surface of the base web 140 (see FIG. 2), and a tendency to cause transverse shrinking of the base web in the vicinity of the patterned and/or banded regions. As to the last point, it has been observed that when applying an aqueous starch solution to a base web about 36 inch in transverse dimension, the web may shrink about from 0.50 inch to 0.75 inch or more upon drying. This degree of shrinking would frustrate maintaining proper web tracking through printing and other conversion operations.

Since shrinkage is localized to the patterned and/or banded regions, the transverse width of the base web in the space between adjacent patterned and/or banded regions is greater than the transverse width of the base web in the patterned and/or banded regions. That disparity in transverse width gives rise to transverse waviness in the base web in those spaces between patterned and/or banded regions.

Such waviness in the wrapper adversely affects both the subsequent handling of the wrapper and the manufacture of smoking articles from the wrapper. For example, when wrapper with waviness is wound on a spool, or slit and wound on bobbins, the winding process flattens the waviness causing creases in the wrapper. When the creased wrapper is used to manufacture smoking articles, those creases in the wrapper are carried into the smoking articles resulting in visually unacceptable smoking articles.

Anti-Wrinkling Agent

The inclusion of an anti-wrinkling agent (preferably, such a propylene glycol) in an aqueous starch solution used to make patterned and/or banded wrapper in a manner consistent with the teaching herein can reduce transverse shrinkage to operationally manageable levels, alleviate pronounced wrinkling and essentially eliminate creasing problems that first presented themselves. Inclusion of an anti-wrinkling agent has been found to have additional benefits, too. For example, when an anti-wrinkling agent is incorporated into the aqueous starch solution, the anti-wrinkling agent functions as a plasticizer so that the starch is more elastic during the drying process and in the finished paper. Cracking and flaking at patterned and/or banded regions was alleviated. In addition, the presence of the anti-wrinkling agent appears to cause the starch solution to reside more on the surface of the base web with less penetration into that material, and thus enhance film formation. Shrinkage of the wrapper in the vicinity of patterned and/or banded regions formed from an aqueous starch solution that includes an anti-wrinkling agent has been observed to be in the range of about 0.0625 to 0.125 inch for a 36 inch wide base web—a range which does not result in creasing or excessive waviness. Further, inclusion of an anti-wrinkling agent in the aqueous starch solution has been found to make possible the application of add-on material to be applied to the base web in a single application, printing pass, or the like, provided that sufficient drying capability is established with such practices. Moreover, the inclusion of an anti-wrinkling agent in the aqueous starch solution to be applied in patterns may exhibit more intricacy than solid band regions, because print registration can be more precisely maintained if multiple print stations are used. In addition, the pot life of the aqueous starch solution is materially improved by the inclusion of an anti-wrinkling agent as disclosed herein.

The foregoing advantages will be better understood by those skilled in the art from the following teachings. Referring now to FIG. 2, the regions 126, 126*a* of add-on material determine and regulate the IP and SE characteristics of the smoking article. Those regions 126, 126*a* of add-on material are applied to a base web 140 (see FIG. 2) of the wrapper 123 and then formed into a tobacco rod in conventional cigarette making equipment. Nominal permeability of the base web 140 may be in the range of about 25 to about 100 CORESTA. Currently, the preferred nominal permeability of the base web lies in the range of about 33 to about 65 CORESTA, with the most preferred nominal permeabilities being about 33 and about 60. The base web 140 has a longitudinal direction 142 extending along the length of the wrapper 123 and a transverse direction 144 extending transversely across of the wrapper 123 so as to be generally perpendicular or transverse to the longitudinal direction 142.

Those regions 126, 126*a* of add-on material may be applied to the base web 140 preferably by a printing technique. While one or more printing technique (selected from the group consisting of direct printing, offset printing, inkjet printing, gravure printing, and the like) may be used to apply the region 126, 126*a*, preferably a gravure printing process will be used. Gravure printing provides ample control over deposition rates, deposition patterns, and the like, and is suitable for high-speed printing on the base web 140. For purposes of this disclosure, "high-speed" printing refers to printing processes where the base web 140 advances through the printing process at a linear speed greater than about 300 feet/min. For cigarette manufacturing purposes, base web printing speeds greater than 450 feet/min. are preferred, and speeds greater than 500 feet/minute or more are even more preferred. In this regard, the rates of deposition for add-on material, as well as the quality of the pattern of deposited add-on material, can vary considerably when wrapper prepared by high-speed printing processes is compared with wrapper prepared by low-speed printing processes. Higher-speed printing operations can achieve both desirable IP values (performance) and desired SE values (performance).

Remarkably, it has been found that a base web may be converted (printed) to include bands in accordance with the embodiment described with reference to FIG. 7 at 1000 feet per minute, with acceptable paper appearance (i.e., without quality defects) and without elevated or unacceptable statistical occurrences of creases or wrinkles.

One object of this description is to provide wrappers 123 (see FIG. 2) produced at commercial-scale high-speed which, when formed into a tobacco rod, exhibit IP values no greater than 25%. Accordingly, deposit rates and characteristics of the resulting printed regions are important features of high-speed printing here. While that IP value is considered to be adequate at this time, even more preferred is an IP value for the resulting smoking article no greater than about 15%; and the most preferred IP value for the resulting smoking article is no greater than about 10%. Lower SE values are also desired. In this connection, while an SE value no greater than 50% is desirable, a more preferred SE value is less than about 25%; and the most preferred SE value is less than about 10%.

The materials used for the regions of add-on material can be important in the IP and SE performance of a smoking article manufactured using the wrapper discussed herein. In one embodiment, the regions of add-on material may be printed with a solution comprising a mixture of calcium carbonate (or chalk) particles, starch, and an anti-wrinkling agent. As with the starch and anti-wrinkling agent solution, the solution comprising a mixture of calcium carbonate (or chalk) particles, starch, and an anti-wrinkling agent preferably is applied as an aqueous solution, but a non-aqueous solution also falls within the spirit and scope of this disclosure.

This disclosure contemplates that various anti-wrinkling agents are suitable to attain the desired characteristics described herein. For example, the anti-wrinkling agent can be selected from the group consisting of glycerin, 1,2 propylene glycol, propylene glycol, and the like. In particular, the anti-wrinkling agent propylene glycol is most preferred.

Generally speaking, this disclosure contemplates that a combination of anti-wrinkling agent and calcium carbonate will be added to a nominal aqueous starch solution to obtain the add-on solution to be used for printing. For the nominal aqueous starch solutions used in this description, the starch may comprise from about 25% to about 35%, by weight, of the nominal solution. Preferably, the starch may comprise from about 28% to about 32%, by weight of the nominal solution. Most preferably, starch may comprise about 30%, by weight, of the nominal solution.

An anti-wrinkling agent is preferably added to the nominal starch solution, with the weight of the anti-wrinkling agent being in the range of about 10% of the weight of the starch in the nominal starch solution to an upper value established by the capacity of drying equipment to adequately dry the propylene-glycol containing solution. Quantitatively, that upper value is about 30% for conventional gravure printing apparatus. Preferably, the weight of the anti-wrinkling agent will be in the range of about 20% to about 30%. Most preferably, the weight of the anti-wrinkling agent will be about 25% of the weight of the starch in the nominal starch solution.

EXAMPLES

The following illustrative, non-limiting examples are intended to provide further explanation. The results provided in Tables I and II compare the initial viscosity and time stability of a printing solution without an anti-wrinkling agent additive and to the initial viscosity and time stability of a printing solution with an anti-wrinkling agent additive. The observations recorded in Table I (for 1,2 propylene glycol) and Table II (for glycerin) show that a printing solution containing an anti-wrinkling agent such as 1,2 propylene glycol or glycerin is less viscous initially and more stable in that it has a lower viscosity for a much longer period of time.

TABLE I

| | Viscosity of 24% starch solution + 80% $CaCO_3$[1] | Viscosity of 24% starch solution + 80% $CaCO_3$ + 100% 1,2 propylene glycol[2] |
|---|---|---|
| Day 1 | 65 centipoises (cp) | 50 |
| Day 2 | 71 | 51 |
| Day 3 | 77 | 50 |
| Day 4 | 88 | — |
| Day 6 | — | 52 |
| Day 7 | 147 | 58 |
| Day 8 | — | 61 |
| Day 9 | — | 66 |
| Day 10 | 225 | 70 |
| Day 16 | — | 114 |

[1]$CaCO_3$ added to a solution of 24% dry starch in water; ratio by weight of added $CaCO_3$ to dry starch present in the solution is 0.8:1.0.
[2]$CaCO_3$ added to a solution of 24% dry starch in water; ratio by weight of added 1,2 propylene glycol to added $CaCO_3$ to dry starch present in the solution is 1.0:0.8; 1.0.

TABLE II

| | Viscosity of 20% starch solution + $CaCO_3$[1] | Viscosity of 20% starch solution + $CaCO_3$ + glycerin[2] |
|---|---|---|
| Day 1 | 51 centipoises (cp) | 41 cp |
| Day 2 | 50 cp | — |
| Day 5 | 66 cp | 52 cp |
| Day 6 | 78 cp | — |
| Day 7 | 102 cp | — |
| Day 8 | — | 55 cp |
| Day 12 | — | 62 cp |
| Day 14 | — | 72 cp |

[1]$CaCO_3$ added to a solution of 20% dry starch in water; ratio by weight of added $CaCO_3$ to dry starch present in the solution is 1:1.
[2]$CaCO_3$ and glycerin added to a solution of 20% dry starch in water; the ratio by weight of added glycerin to added $CaCO_3$ to dry starch present in the solution is 1:5:5.

The foregoing Tables demonstrate that the useful shelf-life of the printing solution using an anti-wrinkling agent, as measured by its viscosity, essentially doubles the shelf-life of a printing solution without the anti-wrinkling agent. The addition of an anti-wrinkling agent in the material applied to the add-on regions thus improves rheological properties of the printing solution used to form the regions of add-on material.

When the add-on material is applied with a printing technique, viscosity of the applied material is important. Where the viscosity of the applied material increases over time, the add-on material has a finite shelf life, or pot life, after which the material loses its usefulness. As Table I demonstrates, with the addition of an anti-wrinkling agent to the applied material formulation, the initial viscosity of add-on material can be reduced by about 20%. Moreover, the shelf life, or pot life, of the add-on material increases by a factor of at least two or more compared to material not having an anti-wrinkling agent.

The results provided in Tables III and IV indicate that addition of an anti-wrinkling agent to the printing solution has been found to reduce free-burn SE without unacceptably affecting IP performance (i.e., while maintaining an acceptable IP levels). For purposes of the information presented in Table III, batches of 40 cigarettes were tested to obtain the IP performance, while batches of 20 cigarettes were tested at each angular position to obtain the SE performance.

TABLE III

| Print solution with 22% Starch + 100% 1,2 propylene Glycol[1] + $CaCO_3$ | | | | | | |
|---|---|---|---|---|---|---|
| $CaCO_3$% | Width, mm | IP % | SE(0°) | SE(45°) | SE(90°) | SE(Avg) |
| 40 | 7 | 0 | 40 | 85 | 100 | 75 |
| | 7 | 0 | 35 | 90 | 100 | 75 |
| | 6 | 0 | 75 | 100 | 100 | 92 |
| | 6 | 5 | 0 | 60 | 100 | 53 |
| 60 | 7 | 0 | 10 | 80 | 100 | 63 |
| | 7 | 0 | 10 | 75 | 95 | 60 |
| | 6 | 5 | 25 | 85 | 100 | 70 |
| | 6 | 10 | 5 | 40 | 50 | 32 |
| 80 | 7 | 7.5 | 5 | 60 | 90 | 51 |
| | 7 | 5 | 0 | 65 | 85 | 50 |
| | 6 | 25 | 0 | 45 | 50 | 32 |

[1]1,2 propylene glycol added to a solution of 22% dry starch in water; 1,2 propylene glycol added to the starch solution with the ratio of 1,2 propylene glycol to dry starch being 1.0:1.0; and $CaCO_3$ being added to the starch solution in the weight percentage stated, measured relative to the weight of dry starch used in the solution.

From Table III, certain conclusions can be drawn. For example, the IP stayed well under the 25% target value for 7 mm bands. In addition the IP stayed well under the 25% target value when $CaCO_3$ weight was less than 80% of the starch weight. Further, the average SE value was less than or equal to 70% when $CaCO_3$ weight was greater than 40% of the starch weight; and SE at 0° was less than or equal to 25 when $CaCO_3$ weight was greater than 40% of the starch weight.

Inclusion of an anti-wrinkling agent in the add-on material also enhances characteristics of the resulting patterned and/or banded wrapper. More particularly, an anti-wrinkling agent has been found to increase flexibility of add-on material when dried on the wrapper (i.e., it acts as a plasticizer). As a result, bands of add-on material are less prone to separate from the base web during handling and use than bands on wrapper where an anti-wrinkling agent is not used in the formulation. Furthermore, as noted above, incorporation of an anti-wrinkling agent in the add-on material gives rise to improved SE performance in a smoking article fabricated from wrapper having bands of add-on material including an anti-wrinkling agent—but without degradation of IP performance.

While the operation of the anti-wrinkling agent in the starch solution is not fully understood, it appears that the anti-wrinkling agent also functions as a plasticizer in the starch solution. A starch solution without an anti-wrinkling agent capable of also functioning as a plasticizer tends to infiltrate the top surface of the paper structure. Moreover, without the agent, a starch solution tends shrink or contract when it dries. That shrinkage and/or contraction causes the underlying web to also shrink or contract, i.e., in the area underlying the patterned and/or banded region. By way of example, observations have shown that the width of a 36 inch wide paper web may shrink by as much as about 0.5 to about 0.75 inches in the patterned and/or banded region—in other words by over 1 to about 2%.

Since the underlying web, between patterned and/or banded regions, does not experience the shrinkage, the region between the patterned and/or banded regions exhibits waviness, where the waves extend in the longitudinal direction of the underlying web and the undulations of the waves occur in the cross-web or transverse direction of the underlying web. After the underlying web is slit longitudinally into portions sized to manufacture cigarettes, each of those longitudinal portions of the paper web is wound tightly on a corresponding bobbin. Accordingly, the undulations described above sometimes result in creases in the unbanded regions where the paper folds on itself to adjust to the width reduction caused by shrinkage in the patterned and/or banded regions. Such creases in the wrapper are generally unacceptable for tobacco rod production.

Thus, the shrinkage of the patterned and/or banded regions appears to be a cause of wrinkling in the unbanded, or unprinted, area of the wrapper. Again, the mechanisms are not fully understood, but the addition of an anti-wrinkling agent to the starch solution appears to cause the printed layer or banded region to be more flexible. That flexibility may result from the printed starch layer being more elastic. That flexibility may also result from the printed layer having reduced infiltration into the paper structure such that the printed layer lies more on the surface of the paper web. Regardless of whether those mechanisms, a combination of those mechanisms, or some other mechanism is active, observations indicate that, when the wrapper flexes, the enhanced elasticity of the layer or patterned and/or banded region reduces the likelihood that the layer or patterned and/or banded region will separate from the wrapper. Moreover, the elasticity of the layer or patterned and/or banded region appears to allow the layer or banded region to dimensionally conform to the underlying paper as the applied solution dries—hence shrinkage in the patterned and/or banded region is reduced and, simultaneously, wrinkling and/or puckering between the patterned and/or banded regions is also reduced. Accordingly, incorporating the anti-wrinkling agent in the starch solution counteracts the wrinkling described above.

A further advantage of the anti-wrinkling agent herein disclosed concerns the film-forming attributes of the solution. More particularly, inclusion of the anti-wrinkling agent in the add-on material seems to enhance the film-forming characteristic of the add-on material with respect to the surface of the base web to which the add-on material is applied. That improved film-forming characteristic is believed to enhance the IP performance of patterned and/or banded wrappers constructed from the add-on material.

With the addition of an anti-wrinkling agent to the starch solution, permeability of the patterned and/or banded region is improved, i.e., the permeability is more uniform and is lower than permeability for a band that does not use plasticizer. This phenomenon is significant because it permits the required quantity of starch solution to be applied or printed in a single printing step. Those skilled in the art will appreciate that, in the past, multiple printing steps were typically needed to effect the necessary permeability reduction in the patterned and/or banded regions.

Calcium Carbonate

Calcium carbonate, or chalk, is preferably added to the nominal starch solution in addition to the anti-wrinkling agent, the weight of chalk may lie in the range of about 30% to about 80% of the weight of starch in the nominal solution.

Where 33 CORESTA paper is used, addition of about 60% calcium carbonate is presently preferred. When 46 or 60 CORESTA paper is used, addition of about 80% calcium carbonate is presently preferred. Chalk may be added to the nominal starch solution to adjust the reflectance of the resulting add-on material so as to be comparable to the reflectance of the uncoated base web material. With such reflectance, patterned and/or banded regions constructed from the add-on material are less visible to the casual observer.

The $CaCO_3$-to-starch ratio may also be a significant factor in determining IP and SE performance of a smoking article fashioned from the wrapper of this disclosure, when prepared by high-speed printing. The $CaCO_3$-to-starch ratio is determined as the ratio, by weight, of calcium carbonate to starch for the region of add-on material. More specifically, a $CaCO_3$-to-starch ratio of less than about 0.8 is preferred to obtain desired IP performance together with improved SE (at 0°) performance less than about 25%. $CaCO_3$ is included in the make-up of the described embodiment to enhance its SE performance, among the other reasons set forth herein.

The foregoing description and the attached drawings will aid those skilled in the art to understand a method of manufacturing a patterned and/or banded wrapper for smoking articles. In that process, patterned and/or banded regions 126,126*a* (see FIG. 2) of add-on material are established as spaced locations on one surface of the base web 123. Spacing of those patterned and/or banded regions 126,126*a* may be selected so as to be substantially greater than the width of those patterned and/or banded regions 126, 126*a* in the longitudinal direction 142 of the base web 140. The width of the patterned and/or banded regions 126, 126*a* may be selected to lie in the range of about 5 to about 10 mm (millimeters); and the spacing between those patterned and/or banded regions 126, 126*a* (that spacing being measured as the distance from the trailing edge of one patterned and/or banded region to the leading edge of the next adjacent patterned and/or banded region) may be in the range of about 12 to about 40 mm.

Preferred Starch Compositions and their Preparation

Patterned and/or banded regions of this disclosure preferably comprise an aqueous solution containing starch, chalk or $CaCO_3$, and an anti-wrinkling agent. While many types of starch are contemplated, tapioca starch is presently preferred for the starch component of the layer. A suitable commercially available starch is FLO-MAX8 available from National Starch, a subsidiary of Corn Products International.

It has been found that certain characteristics of the starch material give rise to predetermined patterns that yield very low Ignition Propensity values when the patterned base paper is formed into smoking articles. Even more surprising has been the realization that within the standard specifications for some well-known starch materials, batch-to-batch variations in material properties can affect the Ignition Propensity of the resulting smoking articles. By way of example, the specifications of an oxidized tapioca starch commercially offered by National Starch as Flo-Max 8 indicate a pH in a 1% solution lying in the range of 4.5 to 6.5, with particles having molecular weights in excess of 10,000. Surprisingly, when a predetermined pattern was applied to a base web with a batch of Flo-Max 8 having a pH in the range of about 6 to about 6.5, IP has been found to be much improved when compared to other batches of Flo-Max 8 for which the pH was less than about 6 but still within the manufacturer's specifications.

Various balances or trade-offs need to be made in selection of starch parameters for use in applying films to wrapper. For example, while high molecular weight starch may give rise to effective permeability reduction, such high molecular weight starches must be used in low concentrations, resulting in a solution having a very high water content. But high-water-content films are much more difficult to effectively dry on porous wrapper.

Although not fully understood, the preferred pH range of the oxidized starch is believed to reflect a lower degree—or less complete—oxidation of the starch polymer chains giving more, longer polymer chains than the more acidic (i.e., lower pH) starches.

Based on these understandings, it has been found that marked improvement in the IP of patterned wrapper results for starch solutions having particular, and improved, characteristics. Those characteristics for an aqueous solution including oxidized starch include a pH in the range of about 6 to about 6.5; a surface tension of at least about 65 dynes/centimeter; a room temperature viscosity of no greater than about 50 centipoises; and a particle size distribution in the range of about 4 to about 40 microns for dry particles. Furthermore, the particles preferably have a molecular weight such that the solution can have starch concentrations in the range of about 25% to about 35%. Preferably, the starch comprises an oxidized tapioca starch.

The aqueous starch solutions used for application to the base web or wrapper are typically prepared by making a starch/water mixture by first mixing the desired weight of dry starch powder with the desired weight of room temperature water (i.e., at about 15° C. to about 25° C.) to obtain a starch/water mixture having the preselected concentration. For example, to prepare a starch/water solution with a preselected concentration of 20%, 20 parts by weight of starch are mixed with 80 parts by weight of water. The starch/water solution is then heated to an elevated sub-boiling temperature in the range of about 90° C. to about 95° C.—i.e., below the boiling temperature. The starch/water solution is held at the elevated temperature for about 20 to about 30 minutes for thermal soaking. Then, the starch/water solution is cooled to room temperature. That cooling step can occur by passively, such as by naturally occurring heat transfer processes; or the cooling step can be active (or forced) such as by immersion in a cooling bath or by use of a conventional mechanical cooling system. Throughout the mixing step, the heating step, the thermal soaking step, and the cooling step, the starch/water mixture is stirred. The stirring can be continuous or substantially continuous. If additional constituents, such as calcium carbonate, are to be incorporated into the starch/water solution, those constituents should be added after the starch/water solution returns to room temperature following the thermal soaking step.

Aqueous starch solutions having the characteristics specified above and prepared in the manner described above can be applied to a base web using any of a multitude of printing techniques including, by way of example and without limitation, the group consisting of gravure printing, offset printing, inkjet printing, spraying, and die printing. Other printing processes may also be suitable and are intended to lie within the teachings of this specification. Preferably, however, gravure printing may be used to apply the starch solution to a base web to obtain a patterned wrapper.

Surprisingly, it has been found that the $CaCO_3$/starch ratio is a significant factor in determining IP and SE performance of a smoking article fashioned from the wrapper of this disclosure prepared by high-speed printing. The $CaCO_3$/starch ratio is determined as the ratio, by weight, of calcium carbonate to starch for the region 126,126*a* of add-on material. More specifically, a $CaCO_3$/starch ratio of at least about 60% is preferred to obtain IP and SE(0) performance less than about 25%. Even more preferred is a $CaCO_3$/starch ratio of at least about 70% to obtain IP and SE(0) performance less than about 20%.

Many types of calcium carbonate particles are contemplated as falling within the spirit and scope of this disclosure. Presently, however, calcium carbonate available from Solvay Chemicals, Inc., as SOCAL 31 is a suitable commercially available calcium carbonate. SOCAL 31 is an ultrafine, precipitated form of calcium carbonate having an average particle size of about 70 nm (nanometers). Larger particles of calcium carbonate have been observed to not function as well in this application when compared to the ultrafine, precipitated form of calcium carbonate, due at least in part to the tendency of larger particles to precipitate from solution more quickly and due at least in part to the need for greater quantities to attain the beneficial characteristics discussed herein.

The materials used for the regions of add-on material can be important in the IP and SE performance of a smoking article manufactured using the wrapper discussed herein. In one embodiment, the regions of add-on material may be printed with a starch solution that includes an anti-wrinkling agent and calcium carbonate (or chalk). While an aqueous starch solution is presently preferred as the aqueous component is readily dried, use of a non-aqueous starch solution is also within the spirit and scope of this disclosure.

As discussed in more detail above, incorporation of an anti-wrinkling agent in the starch solution permits the aqueous starch solution to be applied in a single printing step or layer to the underlying paper web.

A presently preferred solution may comprise at the press (all percentages here being based on the total solution weight): starch—in amount of about 18 to about 23 wt % (weight-percent), more preferably about 20 to about 22 wt %, and even more preferably about 21 wt % of the total solution weight; propylene glycol—in an amount ranging from about 7 to about 10 wt %, more preferably about 7 to about 9 wt %, and even more preferably about 8 wt % of the total solution weight; calcium carbonate—in an amount in the range of about 9 to about 13 wt %, more preferably about 10 to about 12 wt %, and even more preferably about 11 wt % of the total solution weight, with water essentially comprising the remainder (in an amount ranging from about 55 to about 65 wt %, more preferably about 60 wt %).

Figure 4:
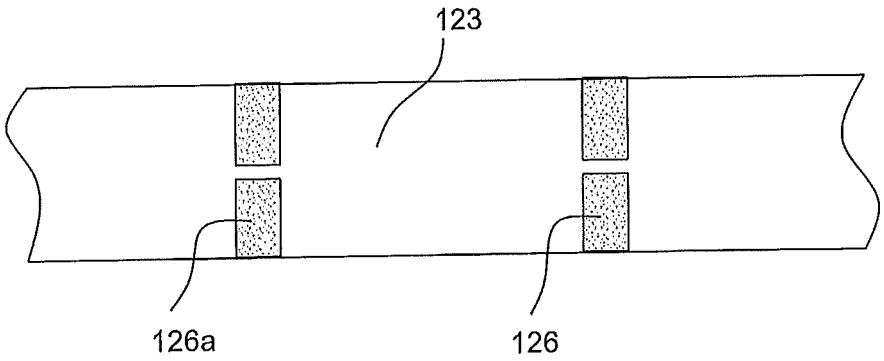
FIG. 4 is a schematic view of wrapper according to a further embodiment of this disclosure.
Figure 5:
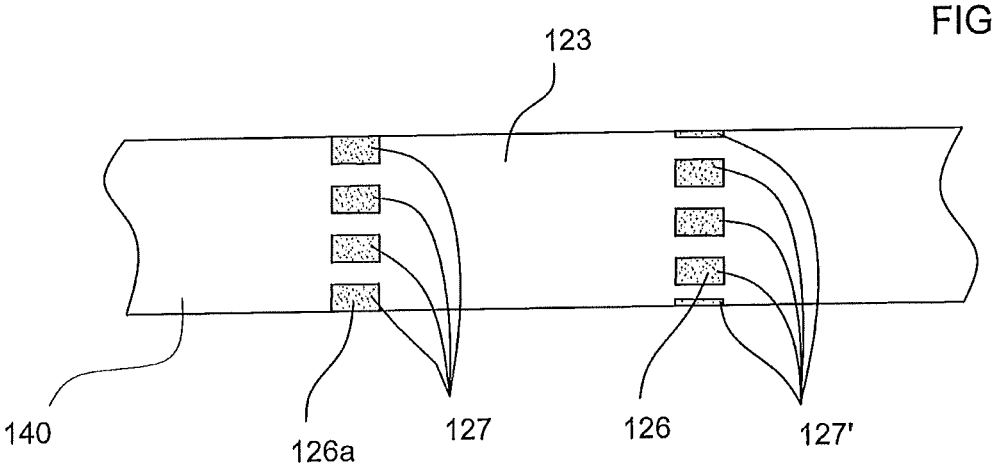
FIG. 5 is a schematic view of wrapper according to yet another embodiment of this disclosure.

From the discussion above, it will now be apparent to those skilled in the art that many different patterns for the patterned and/or banded regions of wrapper fall within the spirit and scope of this disclosure. For example, a pattern comprising a plurality of solid transversely extending bands has been described (see FIG. 2). Solid bands might also contain a discontinuity (see FIG. 4) or several repeating discontinuities (see FIG. 5). The description as being solid meaning, for purposes of this disclosure, that the regions of add-on material are applied in a single step.

Improved SE Performance while Maintaining IP Performance

As noted above, it is desirable to achieve IP performance that meets and preferably exceeds governmental requirements. Such is achievable with a solid band configuration such as that described with reference to FIG. 7. Moreover, as also previously noted, that heightened IP performance may adversely impact the SE performance of the smoking article. Stated differently, while the IP performance may meet or exceed the governmental requirements, that IP performance is typically associated with a smoking article that will self extinguish when hand held by a smoker—an SE of 100%. Since smokers ordinarily prefer not to need to relight a smoking article, improvement of SE performance while maintaining IP performance constitutes a highly desirable feature for improved wrappers. Applicants have discovered arrangements of the patterned and/or banded regions on wrapper that provide such improved SE performance while maintaining the IP performance. For example, the inclusion of chalk content in the embodiment described with reference to FIG. 7 contributes enhancement of SE performance amongst other attributes.

Figure 3:
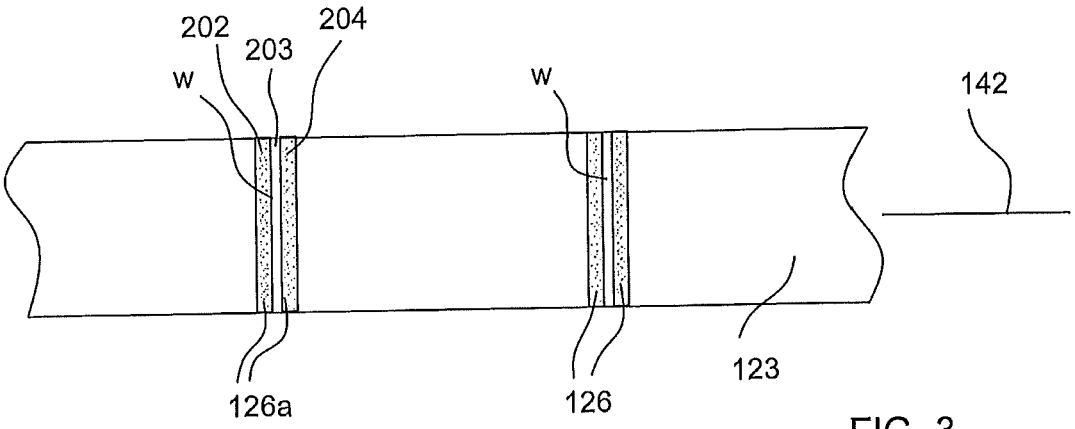
FIG. 3 is a schematic view of wrapper according to another embodiment of this disclosure.

In addition to or in lieu of applying chalk to improve SE performance, certain band configurations and patterns disclosed herein are useful in constructing smoking articles having both improved SE performance and desired IP performance. For example, a slit band configuration such as shown in FIG. 3 and others is capable of better sustaining smoldering during free burns, yet when placed adjacent a substrate, does not sustain smoldering.

Referring to Table V, wrapper A comprises a slit band arrangement, having three regions of about 2 mm each, for a total width of 6 mm for the printed patterned and/or banded region with add-on rates in the various regions ranging from about 3.5× to about 5.5×. The add-on rates result in about 1 $g/m^2$ to about 9 $g/m^2$ of add-on material on a dry weight basis, where the wrapper has a nominal basis weight of about 26.5 $g/m^2$. Lower add-on rates would be expected to provide proportionally adjusted values for the weight of the add-on material, measured on a dry weight basis. The width of the patterned and/or banded regions are typically measured in the longitudinal direction, and have a 27 mm phase (i.e., the spacing from the leading edge of a patterned and/or banded region to the leading edge of the next or subsequent patterned and/or banded region).

TABLE V

| Wrapper | Banded Region Configuration | Total Banded Region Width | Base Web Permeability |
|---|---|---|---|
| A | 2-2-2 | 6 mm | 33 CORESTA |
| B | 2.5-2-2.5 | 7 mm | 33 CORESTA |
| C | 2.5-2-2.5 | 7 mm | 60 CORESTA |
| D | 3-2-3 | 8 mm | 60 CORESTA |

In Table V, the "banded region configuration" is a shorthand description of the width of portions of the band, viewed in the direction which the coal advances in a burning tobacco rod. Thus, the 2.5-2-2.5 configuration (see FIG. 3) of the patterned and/or banded region 126,126*a* means that the first portion or zone 202 of the total patterned and/or banded region width is 2.5 mm, the second portion or zone 203 of the total patterned and/or banded region width is 2 mm (and may be a space), and the third portion or zone 204 of the total patterned and/or banded region width is 2.5 mm. Here, the first portion 202 would be encountered first by the advancing coal of a burning tobacco rod, the second portion 203 would be encountered next by the advancing coal, and the third portion 204 would be encountered last by the advancing coal.

TABLE VI

| Details of Wrapper A | | | |
|---|---|---|---|
| | Zone 1 | Zone 2 | Zone 3 |
| Width | 2 mm | 2 mm | 2 mm |
| Layers of Add-on | 1 | 1 | 1 |

TABLE VI-continued

| Details of Wrapper A | | | |
|---|---|---|---|
| | Zone 1 | Zone 2 | Zone 3 |
| Material | | | |
| Add-on Rate Per Layer | 5x | 3.5-4x | 5x |
| Total Add-on Material | 5x | 3.5-4x | 5x |

TABLE VII

| Details of Wrapper B | | | |
|---|---|---|---|
| | Zone 1 | Zone 2 | Zone 3 |
| Width | 2.5 mm | 2 mm | 2.5 mm |
| Layers of Add-on Material | 1 | 1 | 1 |
| Add-on Rate Per Layer | 5x | 3.5-4x | 5x |
| Total Add-on Material | 5x | 3.5-4x | 5x |

TABLE VIII

| Details of Wrapper C | | | |
|---|---|---|---|
| | Zone 1 | Zone 2 | Zone 3 |
| Width | 2.5 mm | 2 mm | 2.5 mm |
| Layers of Add-on Material | 1 | 1 | 1 |
| Add-on Rate Per Layer | 5x | 3.5-4x | 5x |
| Total Add-on Material | 5x | 3.5-4x | 5x |

TABLE IX

| Details of Wrapper D | | | |
|---|---|---|---|
| | Zone 1 | Zone 2 | Zone 3 |
| Width | 3 mm | 2 mm | 3 mm |
| Layers of Add-on Material | 1 | 1 | 1 |
| Add-on Rate Per Layer | 5x | 3.5-4x | 5x |
| Total Add-on Material | 5x | 3.5-4x | 5x |

Tables VI-IX show that the multizone patterned and/or banded region 126 (see FIG. 3) may be fashioned in a single pass printing operation with the application rates indicated in those tables. In each of wrappers A through D, the add-on material preferably included an aqueous solution containing starch, chalk or calcium carbonate, and propylene glycol. A presently preferred mixture for that aqueous solution includes starch, chalk, and propylene glycol in a weight ratio of about 100 (for starch), to about 30% to about 80% (for chalk), to about 20% to about 30% (for propylene glycol), where the chalk and propylene glycol components are expressed as percentages of the weight of starch in the solution. The starch alone may be in the range of about 25% to about 35% in the aqueous solution.

Some changes in the relative proportions of constituents of the add-on material may change when the aqueous solution is applied to a base web and dried. For example, observations indicate that when 1,2 propylene glycol is used as the anti-wrinkling agent, about 50% to about 60% of the propylene glycol added to the solution remains in the add-on material when it has dried on the paper web. Some weight loss may also occur in other anti-wrinkling agents during the drying process. However, such weight loss has not been observed with respect to the starch and calcium carbonate constituents of the add-on material during the drying process.

The region 126,126*a* of add-on material may be substantially continuous transversely of the paper web, as shown (see FIG. 2), or may have one or more longitudinally extending separations so as to define a C-shaped region when formed into a wrapper for a tobacco rod (see FIG. 4), or may have several separations that result in multiple portions of material 127' (see FIG. 5) generally symmetrically positioned around the tobacco rod when viewed in cross section transverse to the longitudinal axis 134 of the tobacco rod 122 (see FIG. 1).

In addition, the region 126, 126*a* of add-on material on the wrapper 123 may be divided into two or more substantially ring-shaped portions (see FIG. 3) that are spaced from one another along the axis 142 by a distance, w, that typically does not exceed the width of the rings 126, 126*a*, when measured in a direction generally parallel to the axis 134 of the tobacco rod 122. Such a spacing feature provides a "slit" in the band structure.

It is also within the contemplation of this disclosure that the region 126, 126*a* on the wrapper 123 may comprise a plurality of patches 127 (see FIG. 5) that may ultimately be disposed circumferentially around the tobacco rod 122, with patches 127' of an adjacent region 126, 126*a* being circumferentially displaced from patches of other adjacent regions 126, 126*a*. In addition, the patches 127, 127' may be arranged according to a predetermined pattern such as taught in U.S. Patent Application Ser. No. 60/924,666 and U.S. Patent Application Publication 2008/0295854, the entire contents of both documents are incorporated herein by this reference thereto.

The regions of add-on material are preferably applied in a single layer 210 (see FIG. 6). It should be noted that the representation of the base web cross section in FIG. 6 is schematic. As discussed above, the actual cross section of a base web is a slice through the myriad of fibers which form the base web. In the case of cigarette wrapper, that thickness may be on the order of about 30 microns (i.e., $30\times10^{-6}$ meters or 30 μm). Actual thickness of the add-on materials ≤2 μm, and the add-on material tends to infiltrate and conform to the surface presented by the fibers of the base web. As a result, material build-up in the regions of add-on material can be schematically shown as boxes (as in FIG. 6), but actually are nearly imperceptible to the unaided eye.

The application rate of the material in the preferred single layer (see FIG. 6) may be in the range of about 4× to about 6×. For these purposes, the "X" has been described above. Where the base web has a nominal CORESTA value of about 33, a presently preferred application rate of about 6× is believed to be appropriate. Where the base web has a nominal CORESTA value of about 60, a presently preferred application rate of about 5.5× is believed to be appropriate.

Figure 9:
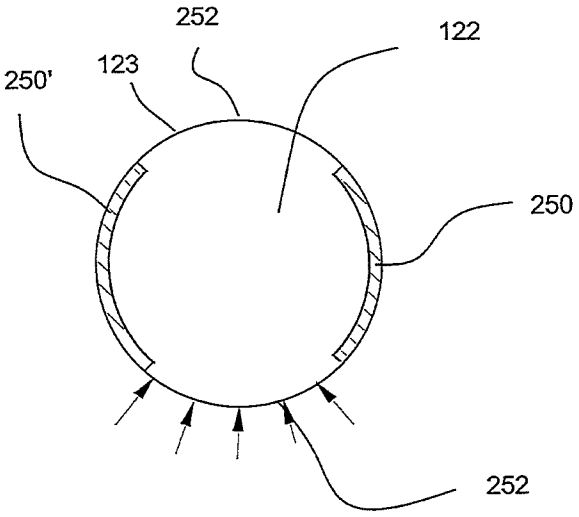
FIG. 9 is an enlarged cross-sectional view of the smoking article removed from the substrate and illustrating airflow to a smoldering coal.

The smoking article 120 (see FIG. 7) may include one or more patterned and/or banded regions 250, 250*a* that are axially spaced from one another along the axis of the smoking article 120. Each patterned and/or banded region 250, 250*a* may include add-on material applied such that at least one longitudinally extending gap 252 exists between end portions 254 of the patterned and/or banded region 250, 250*a*, and such that the IP performance of adjacent bands is different. The embodiment of FIG. 7 shows a single gap 252 in each of the patterned and/or banded regions 250; however, two or more gaps 252 may be provided around the circumference of the smoking article 120. Where more than one gap 252 is provided, the gaps are preferably generally parallel to one another and preferably are also substantially equally spaced from one another around the circumference of the smoking article 120. An embodiment of the smoking article having a pair of substantially diametrically opposed areas of add-on material may be seen in FIGS. 8 and 9. As shown, the circumferential extent of the areas of add-on material 250, 250' may be substantially the same as the circumferential extent of the spaces or gaps 252 between those areas of add-on material 250, 250'.

Figure 13:
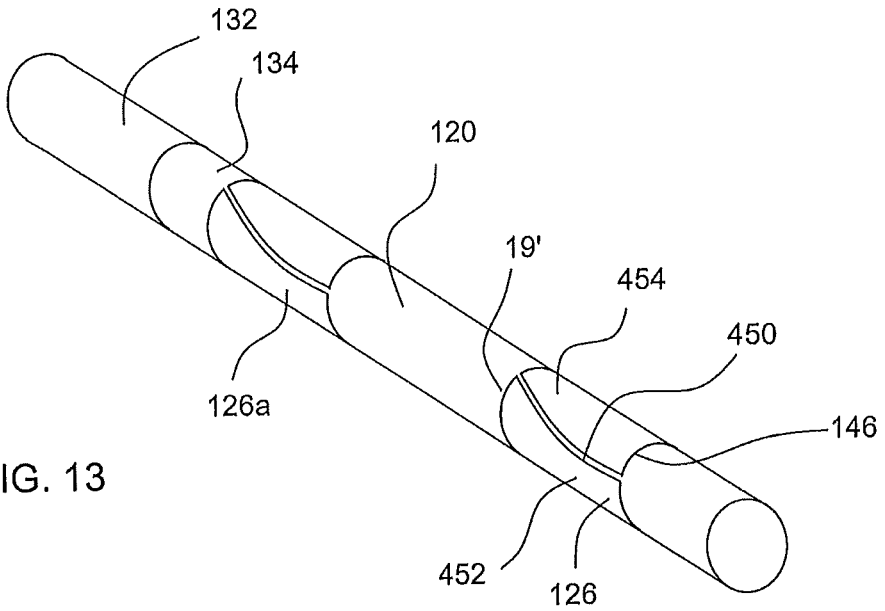
FIG. 13 is a schematic perspective of a further embodiment of the smoking article.

With the foregoing arrangement, when the smoking article 120 exists in free-burn condition (see FIG. 9), the regions of add-on material 250, 250' obstruct airflow to the burning coal of the tobacco rod 122 by virtue of their reduced permeability. On the other hand, with the smoking article held in a substantially horizontal position, the bottom gap 252 of the wrapper 123 freely permits air to enter the side of the tobacco rod 122 to support combustion of the coal. A vastly different situation occurs when the smoking article 120 is placed on a substrate 260 (see FIG. 8). Under these conditions, the substrate 260 blocks the flow of air upwardly to the bottom portion or bottom gap 252 of the tobacco rod 122. The regions of add-on material 250, 250' and the substrate 260 cooperate to define much smaller areas 258, 259 through which air can be drawn through the base web 140 of the wrapper. More specifically, the vertical area 258 between the bottom of the region 250 and the substrate 260 and the vertical area 259 between the bottom of the region 250' and the substrate 260 present a substantial reduction in the area through which air can pass to reach the smoldering coal of the tobacco rod 122. As a result of deprivation of oxygen in the air, the smoldering coal of the smoking article 120 self-extinguishes when the burn line reaches opposed regions of add-on material positioned as depicted in FIG. 13. The condition of substantially reduced area for air to support burning of the coal also exists for rotational positions of the tobacco rod 122 between that position illustrated in FIG. 9 and other positions of the smoking article when rotated about its longitudinal axis.

However, when the smoking article 120 is placed on the substrate 260 such that one of the add-on regions 250, 250' contacts the substrate 260, the add-on regions still may sufficiently restrict the area through which air can pass to and through the base web 140, and there is a lesser degree of material cooperation between the substrate 260 and the add-on regions to effect a reduction in that area, in comparison to what occurs at the snuffer region 252. For purposes of this description, a snuffer region 252 is an area on the tobacco rod 122 which is operable to cause extinguishment of the burning coal when placed on a substrate 260.

Figure 7:
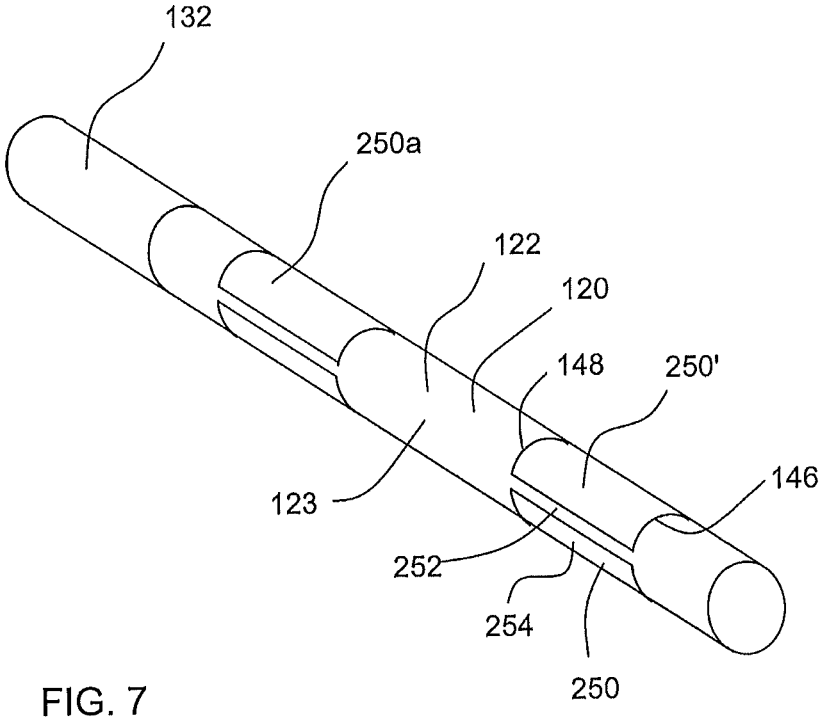
FIG. 7 is a perspective view of still another embodiment of a smoking article according to this disclosure.
Figure 8:
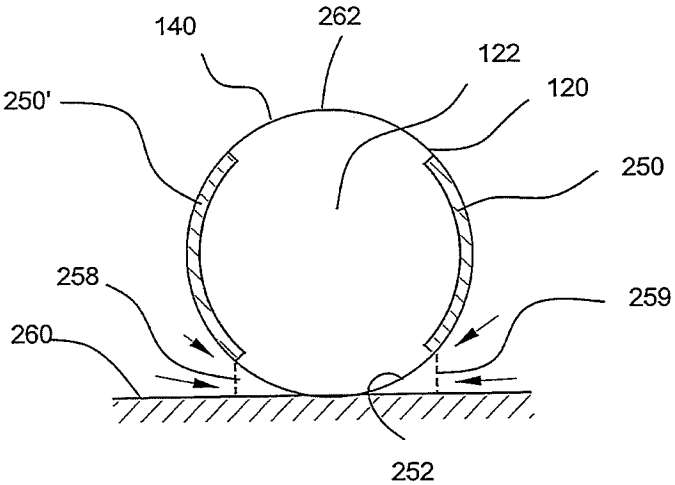
FIG. 8 is an enlarged cross-sectional view of the smoking article positioned on a substrate and illustrating airflow to a smoldering coal.

In the foregoing example, the reduction in IP value is also associated with a reduction in SE value, and improved free-burn quality of a smoking article 120 having a wrapper with regions of add-on material such as those of FIG. 7. It will also be appreciated by those skilled in the art that the SE improvement of FIG. 9 occurs with the smoking article in a horizontal position (i.e., 0°). Similar SE improvements are also observed at other SE evaluation positions of 45° and 90°. Where the smoking article 120 happens to be placed on a substrate 260 at one of three specific orientations, the orientations being spaced (off-set) 45° apart from each other around the axis of the smoking article, the self-extinguishing characteristics and desirable IP are also achieved. Naturally, the discussion proceeded in this manner for the sake of brevity. It will be readily understood that a pattern according to this description can extinguish the smoking article, regardless of which side portion rests against a substrate 260 and without a need for applying film-forming compound to the paper to such an extent that a desirable free-burn quality in the smoking article is lost or such that carbon monoxide levels in the mainstream smoke become elevated. This may be understood by recognizing that opposing regions of film-forming compound need not appear at locations exactly 90° from the side portion in contact with the substrate 260. Those regions may be centered at a location that is closer to or farther from the side portion in contact with the substrate 260, for example, between about 60° and 120° from the side portion in contact with the substrate 260.

Additionally, for a particular chosen pattern, the ability to extinguish the smoking article may depend more on providing minimum lengthwise extent of add-on material (e.g., a film-forming compound), rather than a particular weight per area of film-forming compound at longitudinal locations. The length of a rectangular region, for example, may be no less than about 5.5 mm for a particular design, base web, and film-forming compound used. The amount of film-forming compound used may be increased to improve IP performance, usually without losing a free-burn quality and SE performance, and if desired, a burn accelerator may be applied to the paper to support even higher add-on levels.

Previously, it was thought that a permeability ratio of 3:1 between the base web and regions of add-on material was insufficient to extinguish the smoking article because there is an insufficient reduction in the permeability of the paper at the longitudinal position of the snuffer region. However, that permeability ratio, over a portion of the circumference of the smoking article, may be sufficient to extinguish the smoking article when there is an underlying substrate 260 and when the add-on material is located at sides of the smoking article 120 not in contact with the substrate 260.

In the embodiments described above, the smoking article has a generally circular cross section. Therefore, it is possible for any side portion of the smoking article to rest against the substrate 260. However, a pattern as taught herein can be such that the burn characteristics described above (IP values no greater than 25% and SE values no greater than 50%) in relation to FIGS. 8 and 9 can be realized, regardless of which side portion of the smoking article happens to rest against the substrate 260. Preferably, the pattern is selected so that when the base web is wrapped around a tobacco rod 122, zones of film-forming compound appear at opposing sides not in contact with the substrate 260 at one or more (preferably at least two) longitudinal locations along the tobacco rod 122.

Slit Banded Regions

Other patterns for the regions of add-on material are also, of course, within the scope of this disclosure. Moreover, the inclusion of an anti-wrinkling agent in the aqueous solutions used to form the patterned and/or banded regions allows intricate patterns to be effected.

For example, in another embodiment, the patterned and/or banded region can comprise first, second and third zones of add-on material, which may be applied by any of the methods disclosed herein, wherein the second zone includes perforations which preferably are filled with an occluding material which melts or is evaporated when the burning coal approaches the patterned and/or banded region to thereby provide the second zone with increased permeability.

Thus, a wrapper of a smoking article is disclosed comprising a base web and at least one transverse patterned and/or banded region with first, second and third zones. The first and third zones comprise add-on material, which reduces permeability of the wrapper. The first and third zones each have a width such that if either of said first or third zone were applied separately to wrappers of smoking articles, the smoking articles would exhibit statistically significant occurrences of total burn through and statistically few or no occurrences of self-extinguishment under free burn conditions. The sum of the widths of the first and third zones is such that if the zones were applied to wrappers of smoking articles as a single continuous band (without a slit or other longitudinal or transverse discontinuity), the smoking articles would exhibit statistically few or no occurrences of total burn through and statistically significant occurrences of self-extinguishment under free burn conditions. The first and third zones are separated by the second zone. The wrapper has greater permeability along the second zone than along the first and third zones. The second zone has a width less than either width of the first and third zones (which can have equal or unequal widths), so that lit smoking articles comprising the first, second and third zones exhibit statistically reduced occurrences of self-extinguishment under free burn conditions, as compared to smoking articles comprising wrappers whereon the first and third zones are applied as a single continuous band, while maintaining statistically few or no occurrences of total burn through. Preferably, the first and third zones are of uniform add-on material across the first and third zones. Optionally, the second zone may have a width essentially equal to the first and third zones.

Total weight of add-on material for the patterned and/or banded region preferably lies in the range of 0.5 to 15 grams per square meter ("gsm"). Conventional cigarette paper is permeable, with the permeability commonly designated in CORESTA, which measures paper permeability in terms of volumetric flow rate (i.e., $cm^3$/sec) per unit area (i.e., $cm^2$) per unit pressure drop (i.e., cm of water). Permeability of the cigarette paper normally exceeds 20 CORESTA and preferably, the cigarette paper has a permeability of about 33 to about 60 CORESTA and a basis weight of about 22-30 gsm. However, permeability through the patterned and/or banded regions and the underlying cigarette paper preferably lies in the range of 0 to 15 CORESTA. The reduction in permeability preferably restricts air flow needed to support combustion of the cigarette coal in the vicinity of the patterned and/or banded region.

The first and third zones preferably have a greater basis weight in grams per square meter than the intermediate second zone; for example, the basis weight in grams per square meter of the first and third zones may be at least twice the basis weight in grams per square meter of the second zone. The second zone may comprise a gap. As used herein, the term "gap" refers to a discrete area of a patterned and/or banded region, between the first and third zones, lacking any permeability reducing add-on material (i.e., containing no layers of permeability reducing add-on material). In order to aid combustion in the second zone, the wrapper may comprise iron oxide at the location of the second zone. The second zone preferably has a greater permeability than the first and third zones.

Non-banded areas of the base web preferably do not comprise permeability reducing add-on material. As described below with reference to FIG. 11, the transverse patterned and/or banded region may comprise greater than three zones. For example, the transverse patterned and/or banded region may comprise, for example, five zones, with the second and fourth zones separating the first, third and fifth zones and the wrapper having greater permeability along the second and fourth zones than along the first, third and fifth zones.

Also provided is a wrapper of a smoking article comprising a base web and a transverse patterned and/or banded region of add-on material. The transverse patterned and/or banded region is designed to cause extinguishment of smoking articles comprising the transverse patterned and/or banded region when left upon a substrate. The wrapper further comprises a more permeable, intermediate zone along the transverse patterned and/or banded region such that the occurrences of self-extinguishments of smoking articles comprising the wrapper is statistically reduced over those without the intermediate zone.

In a further embodiment, a wrapper of a smoking article comprises a base web and at least one transverse patterned and/or banded region comprising first, second and third zones on the base web. The at least one transverse patterned and/or banded region can be free of fillers and optionally at least one of the zones is formed at least in part from an add-on material which includes a filler. The add-on material is preferably uniform across the first and third zones. The first and third zones are outward of the second zone, and the overall wrapper structure at the second zone has a greater permeability compared to the overall wrapper structure at the first and third zones.

Additionally provided is a wrapper of a smoking article comprising a base web and at least one transverse patterned and/or banded region comprising first, second and third zones on the base web. The first and third zones are outward of the second zone, the second zone has a greater permeability compared to the first and third zones, and the second zone and the first and third zones comprise add-on material.

Moreover, provided is a method of making a patterned and/or banded wrapper of a smoking article comprising supplying a base web and forming at least one transverse patterned and/or banded region comprising first, second and third zones on the base web. The first and third zones are outward of the second zone, the second zone has a greater permeability compared to the first and third zones, and at least the first and third zones are formed from an add-on material free of fillers. Optionally at least one of the zones is formed at least in part from an add-on material which includes a filler. The add-on material is preferably uniform across the first and third zones.

Furthermore, provided is a method of making a patterned and/or banded wrapper of a smoking article comprising supplying a base web and forming at least one transverse patterned and/or banded region comprising first, second and third zones on the base web. The first and third zones are outward of the second zone, the second zone has a greater permeability compared to the first and third zones, and the second zone and the first and third zones are formed from an add-on material. Optionally at least one of the zones is formed at least in part from an add-on material which includes a filler. The add-on material is preferably uniform across the first and third zones.

Figure 10:
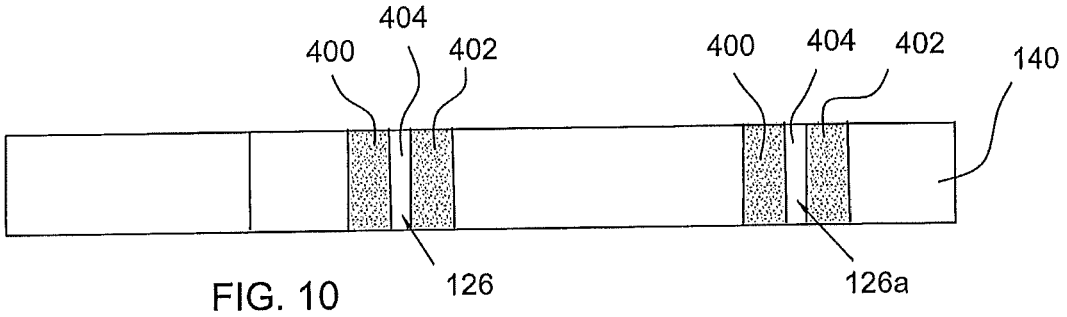
FIG. 10 is a side elevational view of another embodiment of the smoking article.

FIGS. 10-13 illustrate smoking articles comprising slit patterned and/or banded paper as described herein. Specifically, FIG. 10 illustrates a smoking article having two patterned and/or banded regions 126, 126*a*, each comprising first and third zones of add-on material 400, 402 separated by a second zone or discontinuity 404, which may be in the form of a gap or may be in the form of a zone of reduced add-on material. The first and third zones of add-on material 400, 402 may each be, for example, about 2-5 mm wide, and the second zone 404 may be, for example, about 1-2 mm wide. More specifically, the first and third zones of add-on material 400, 402 may each be, for example, about 3 mm wide, and the second zone 404 may be, for example, about 1.5 or about 2 mm wide. The first and third zones of add-on material 400, 402 preferably comprise a single layer of add-on material having the constituents described above. The add-on material is preferably substantially uniform across the first and third zones 400, 402.

Figure 11:
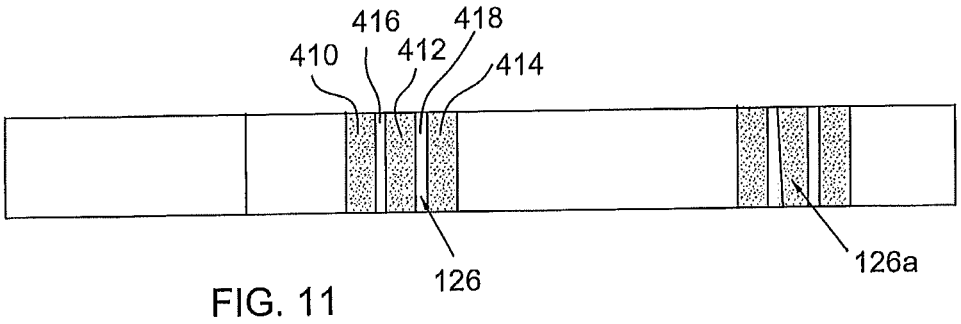
FIG. 11 is a side elevational view of still another embodiment of the smoking article.

FIG. 11 illustrates a smoking article having two banded regions 126, 126*a*, each comprising first, third and fifth zones of add-on material 410, 412, 414 separated by second and fourth zones or discontinuities 416, 418, which may be in the form of gaps or in the form of reduced levels of add-on material. The first, third and fifth zones of add-on material 410, 412, 414 may each be, for example, about 2-3 mm wide, and the second and fourth zones 416, 418 may each be, for example, about 1-2 mm wide. More preferably, the first, third and fifth zones of add-on material 410, 412, 414 may each be, for example, about 2 mm wide, and the second and fourth zones 416, 418 may each be, for example, about 1 mm wide or less. The first, third and fifth zones of add-on material 410, 412, 414 preferably comprise a single layer of add-on material. The add-on material is preferably uniform across the first, third and fifth zones 410, 412, 414.

Figure 12:
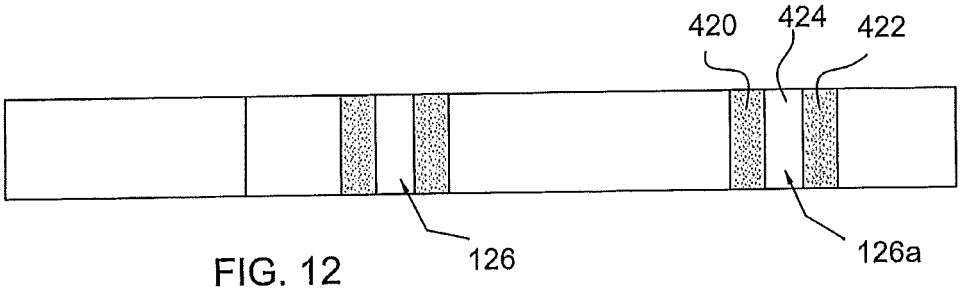
FIG. 12 is a side elevational view of yet still another embodiment of the smoking article.

FIG. 12 illustrates a smoking article having two banded regions 126, 126*a*, each comprising first and third zones of add-on material 420, 422 separated by a second zone 424 of less add-on material. The first and third zones of add-on material 420, 422 may each be, for example, about 2-3 mm wide, and the second zone of less add-on material 424 may be, for example, about 1-3 mm wide. More preferably, the first and third zones of add-on material 420, 422 may each be, for example, about 3 mm wide, and the second zone of less add-on material 424 may be, for example, about 2 mm wide or less. The first and third zones of add-on material 420, 422 preferably comprise a single layer of add-on material. The add-on material is preferably uniform across the first and third zones 420, 422.

Referring to FIGS. 10-13, slit banded paper facilitates use of wrappers of lower permeability for a given level of CO than prior designs of patterned and/or banded paper. For example, it was found that a tobacco rod comprising paper having a permeability of 33 CORESTA and a CO (FTC) delivery of 11 mg would produce 15 mg of CO (FTC) if previous versions of bands were applied without further change. In order to counteract this increase, the permeability of the wrapper would have to be raised to about 46 CORESTA. Such changes create a multitude of consequence in cigarette design, such as, for example, impacting puff count, possibly lessening machineability of the paper, and the like. In contrast, the slit banded paper having a permeability of 33 CORESTA provided 12 mg CO (FTC). Thus, the slit banded technology described herein facilitates application of bands with a lesser impact on CO levels (FTC).

EXAMPLES

The following examples are intended to be non-limiting and merely illustrative. Cigarettes with five different wrappers (i.e., wrappers with five different patterned and/or banded region configurations), were tested for ignition propensity ("IP") and self-extinguishment ("SE") at 0° (horizontal). The base web of each of the wrappers had a permeability of 33 CORESTA and basis weight of 25 gsm.

TABLE X

| Wrapper | Banded Region Configuration* | Total Banded Region Width | IP Run 1 | IP Run 2 | IP Run 3 | IP Avg. | SE @ 0° |
|---|---|---|---|---|---|---|---|
| A | control | 6 mm | 0% | 0% | 0% | 0% | 95% |
| B | 3-1-3 | 7 mm | 0% | 2.5% | 0% | 0.8% | 60% |
| C | 3-2-3 | 8 mm | 0% | 0% | 5% | 1.7% | 25% |
| D | 2-2-2 | 6 mm | 2.5% | 0% | 0% | 0.8% | 45% |
| E | 2-1-2-1-2 | 8 mm | 2.5% | 2.5% | 2.5% | 2.5% | 20% |

*Numbers refer to zone widths in mm (see Tables XI-XV below)

Referring to Table X, wrapper A was a control, comprising a continuous, solid 6 mm printed banded region, having an add-on rate of 5.5×. As used herein, an add-on rate results in about 1-9 gsm of add-on material on a dry weight basis, and a basis weight of 26.5 gsm for 6 mm banded regions with a 27 mm phase (i.e., the spacing from the leading edge of a banded region to the leading edge of the next banded region) applied to a base web with a basis weight of 25 gsm.

TABLE XI

Details of Wrapper B

| | Zone 1 | Zone 2 | Zone 3 |
|---|---|---|---|
| Width | 3 mm | 1 mm | 3 mm |
| Layers of Add-on Material | 2 | 1 | 2 |
| Add-on Rate Per Layer | 1.5x/4x | 1.5x/0 | 1.5x/4x |
| Total Add-on Material | 5.5x | 1.5x | 5.5x |

TABLE XII

Details of Wrapper C

| | Zone 1 | Zone 2 | Zone 3 |
|---|---|---|---|
| Width | 3 mm | 2 mm | 3 mm |
| Layers of Add-on Material | 2 | 1 | 2 |
| Add-on Rate Per Layer | 1.5x/4x | 1.5x/0 | 1.5x/4x |
| Total Add-on Material | 5.5x | 1.5x | 5.5x |

TABLE XIII

Details of Wrapper D

| | Zone 1 | Zone 2 | Zone 3 |
|---|---|---|---|
| Width | 2 mm | 2 mm | 2 mm |
| Layers of Add-on Material | 2 | 2 | 2 |
| Add-on Rate Per Layer | 1.5x/4x | 1.5x/2x | 1.5x/4x |
| Total Add-on Material | 5.5x | 3.5x | 5.5x |

TABLE XIV

Details of Wrapper E

| | Zone 1 | Zone 2 | Zone 3 | Zone 4 | Zone 5 |
|---|---|---|---|---|---|
| Width | 2 mm | 1 mm | 2 mm | 1 mm | 2 mm |
| Layers of Add-on Material | 2 | 1 | 2 | 1 | 2 |
| Add-on Rate Per Layer | 1.5x/4x | 1.5x/0 | 1.5x/4x | 1.5x/0 | 1.5x/4x |
| Total Add-on Material | 5.5x | 1.5x | 5.5x | 1.5x | 5.5x |

As compared to control wrapper A, wrappers B-E exhibited the desired reduction in SE while maintaining IP (i.e., without significantly increasing IP). In particular, wrapper B exhibited an improvement over control wrapper A, as evidenced by the decrease in SE average from 95 to 60%. Further, comparing wrappers B and D, it can be seen that by increasing the width of the second zone from 1 mm to 2 mm, the SE average decreased from 60% to 25% (while approximately maintaining the IP value). Thus, the width of the second zone is preferably greater than 1 mm, preferably about 1.5 mm or about 2 mm. While good results were also shown by wrapper C, which exhibited an SE average of 45%, the best results were shown by wrapper E, which exhibited an SE average of 20%.

It should be noted that wrapper E, having a banded region comprising first, second, third, fourth and fifth zones and which showed the best results, had 1 mm second and fourth zones of greater permeability. In contrast, wrapper B, having a banded region comprising just first, second and third zones, with a 1 mm second zone of a greater permeability, did not perform as well. Thus, wrappers having banded regions comprising just first, second and third zones preferably have wider zones of greater permeability (i.e., about 1.5 mm or about 2 mm) than the zones of greater permeability of wrappers having banded regions comprising first, second, third, fourth and fifth zones.

Moreover, a method of making a patterned and/or banded wrapper of a smoking article may comprise supplying a base web and forming at least one transverse patterned and/or banded region comprising first, second and third zones on the base web. The first and third zones are outward of the second zone, the second zone has a greater permeability compared to the first and third zones, and at least the first and third zones are formed from an add-on material free of fillers. Optionally at least one of the zones is formed at least in part from an add-on material which includes a filler. The add-on material is preferably uniform across the first and third zones.

Furthermore, a method of making a patterned and/or banded wrapper of a smoking article may comprise supplying a base web and forming at least one transverse patterned and/or banded region comprising first, second and third zones on the base web. The first and third zones are outward of the second zone, the second zone has a greater permeability compared to the first and third zones, and the second zone and the first and third zones are formed from an add-on material. Optionally at least one of the zones is formed at least in part from an add-on material which includes a filler. The add-on material is preferably uniform across the first and third zones.

Figure 14:
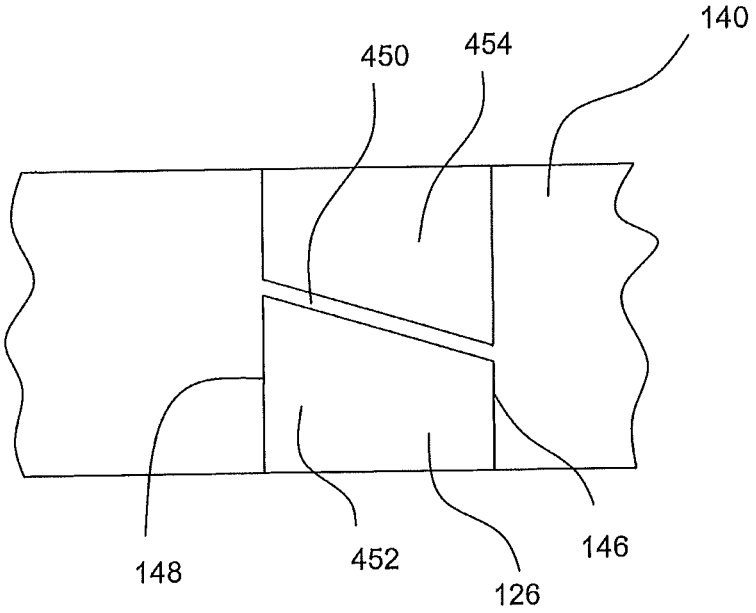
FIG. 14 is a detail view of the wrapper for the embodiment of FIG. 13.
Figure 15:
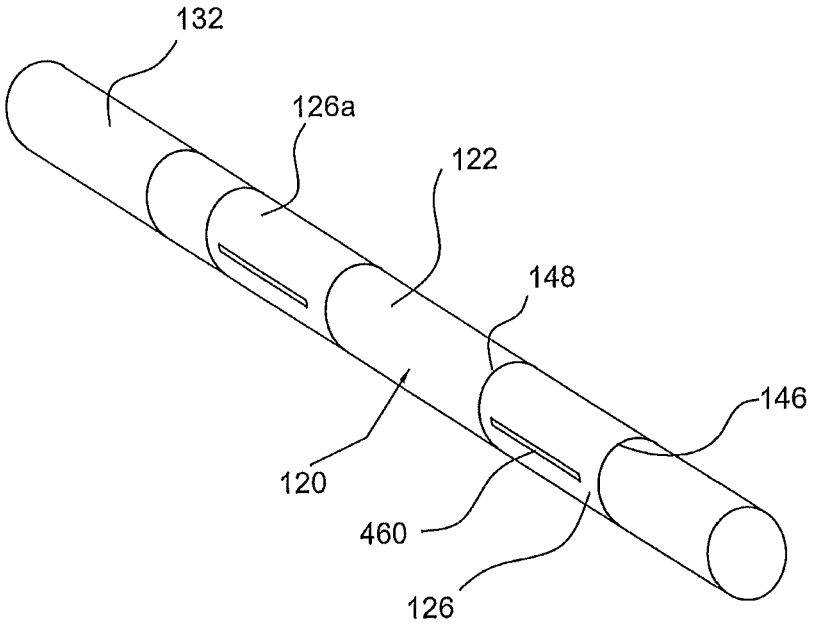
FIG. 15 is a schematic perspective of a still further embodiment of the smoking article.

FIG. 13 is a perspective view of a smoking article 120 having patterned and/or banded regions with angulated slits 450. FIG. 15 is an exemplary representation of angulated slits on an unfolded wrapper 140. FIG. 14 is a perspective view of a smoking article 120 having patterned and/or banded regions 126,126*a* with one or optionally two longitudinal slits or discontinuities 460 that terminate short of the leading edge 146 and the trailing edge 148 of the patterned and/or banded region 126,126*a*.

Figure 16:
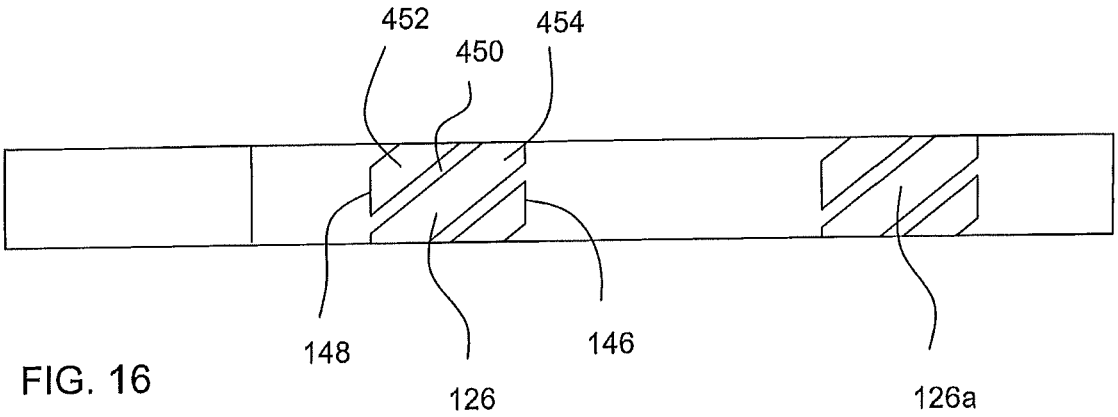
FIG. 16 is a side elevation view of a still another embodiment of a smoking article.

FIG. 16 is a side view of a smoking article comprising patterned and/or banded paper with patterned and/or banded regions having angulated slits as depicted in FIG. 14. In contrast to FIG. 14, however, the angulated slits 450 are inclined in the opposite direction to the slits of FIG. 16.

Figure 17:
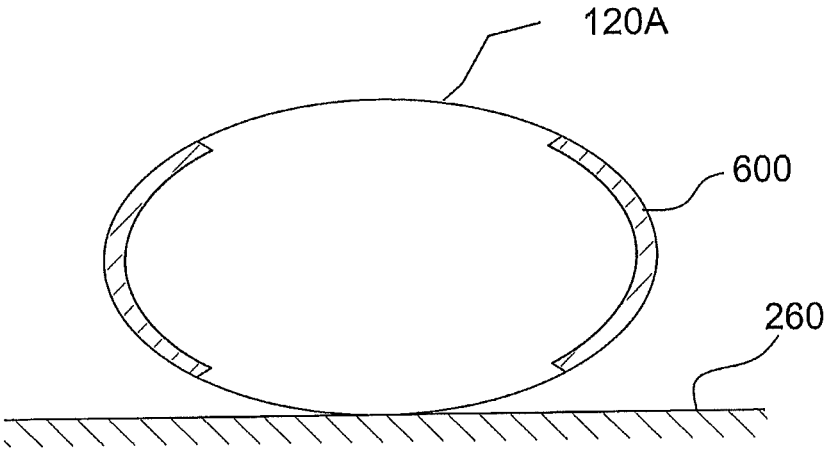
FIG. 17 is an enlarged cross-sectional view of a smoking article having a non-circular cross section.

The geometry of the smoking article 120 may also be designed to aid in achieving a preferred orientation for purposes of IP reduction. For example, the opposed longitudinally patterned and/or banded regions 600 (see FIG. 17) may be located at the edges of the major axis of a substantially elliptical smoking article 120A, where the major axis of the substantially elliptical smoking article 120A naturally rests in a position substantially parallel to the substrate 260 on which the smoking article is placed. Such a smoking article 120A is also known as an oval smoking article.

Due to the nature of an ellipse, it can be appreciated that regardless of how an oval smoking article is placed on the substrate 260, the smoking article 120A will eventually rest in one of two stable positions, with either the upper or lower side resting against the substrate. Therefore, if longitudinally patterned and/or banded regions of add-on material are formed only along the side portions of the generally elliptical article where there is a maximum curvature, film-forming compound will always be present on those side portions of the smoking article 120A that do not contact the substrate 260. Moreover, cooperation between those longitudinally patterned and/or banded regions and the substrate 260 in the stable positions appears to function to restrict airflow into the tobacco rod and leads to self-extinction and a low IP value, regardless of how the smoking article 120 is initially placed on the substrate 230.

The predetermined pattern of add-on material is typically applied to a base web having a permeability lying in the range of about 20 to about 80 CORESTA units. When dry, the add-on material often forms a film on the base web that is effective to locally reduce permeability to values lying in the range of 0 to about 12 CORESTA units, more preferably, 0 to about 10 CORESTA units. The add-on material is preferably applied as an aqueous solution including starch.

Printing Processes

Preferably, the patterned and/or banded region is applied to the wrapper using a gravure printing process. The gravure printing process can be used immediately following paper manufacture, i.e., at a printing station at a location near the end of the paper making machine. Alternatively, the gravure printing process can be used in connection with reels carrying the wrapper onto which the patterned and/or banded regions are to be printed. For example, a reel of wrapper having a selected permeability and a selected basis weight is mounted so that the wrapper can be unspooled from the reel as a continuous base web.

The base web advances or passes through a gravure printing station where the layer of each patterned and/or banded region is printed on the paper. The printing process may be applied to the felt side or the wire side of the paper, or both.

At the gravure printing station, the apparatus includes a gravure cylinder or roller generally mounted for rotation around a horizontal axis. The generally cylindrical surface of the roller is patterned (i.e., with dots, lines, cells, etc.) in a suitable process to define a negative of the first layer of patterned and/or banded regions. Conventional engraving (etching), chemical engraving, electronic engraving, and photo etching can be used to pattern the surface of the gravure cylinder. The circumference of the roller is determined such that it is an integral multiple of the sum of the nominal distance between patterned and/or banded regions plus the patterned and/or banded region width. Thus, for each revolution of the roller, that integral number of first layers of the patterned and/or banded regions is printed on the wrapper.

With gravure printing, while the layer of add-on material may be applied uniformly, the layer of add-on material need not be applied uniformly. For example, a layer of add-on material may be applied such that discrete portions of the layer have differing gsm weights compared to other areas of the layer. This may be accomplished, for example, by a layer of add-on material being applied such that discrete portions of the layer have differing depths than other areas of the layer. This may be accomplished, for example, by patterning the gravure cylinder or roller so as to provide a discrete portion of the layer having a differing depth than other areas of the layer.

The multiple zones, for example, first, second and third zones, of the banded regions described herein may be applied in a single printing stage. When applied in a single printing stage, the zones containing add-on material are applied using an appropriately patterned gravure cylinder or roller. For example, for a banded region containing first, second and third zones, wherein only the first and third zones contain add-on material, the gravure cylinder or roller is patterned so as to apply add-on material only in the first and third zones.

An impression cylinder is mounted for counter-rotation on an axis parallel to the axis of the roller. In some applications, the impression cylinder includes a nonmetallic resilient surface. The impression cylinder is positioned between the roller and a backing roller, which is also mounted for rotation on an axis parallel to the axis of the roller and which counter-rotates relative to the impression cylinder. One of the functions provided by the backing roller is stiffening the central portions of the impression cylinder so that the uniform printing pressure is attained between the roller and the impression cylinder. The gravure cylinder or roller and the impression cylinder cooperate to define a nip through which the base web advances during the printing process. That nip is sized to pinch the base web as it moves between the gravure cylinder and the impression cylinder. The nip pressure on the base web ensures the correct transfer of the composition from the cylinder to the paper.

A reservoir contains the composition discussed above for forming patterned and/or banded regions on the wrapper. The reservoir communicates with a suitable pump which is capable of handling the viscous composition. The composition may then flow to a suitable heat exchanger where the temperature of the composition is elevated so that it lies in the range of about 100° to about 140° C. so that the viscosity of the composition is adjusted to a level which is suitable for gravure printing. As discussed above, viscosity for gravure printing usually needs to be less than about 200 cP. Preferably, the temperature of the composition is selected so that the viscosity is less than about 100 cP.

While a separate heat exchanger is disclosed, it may be desirable to provide thermal conditioning of the composition in the reservoir itself. For example, heating elements and stirring apparatus may be included in the reservoir to maintain the elevated temperature for the composition. Placement of the thermal conditioning in the reservoir has the advantage of making pump selection and operating requirements simpler since the pump need not handle the composition at the higher viscosity associated with lower temperatures because the composition would already be heated and, therefore, at the lower viscosity. Whether thermal conditioning occurs in the reservoir or in a separate heat exchanger, it is important that the thermal conditioning step occur at a temperature selected to avoid scorching the composition. Scorching can cause discoloration of the composition, and can affect the characteristics of the composition. Thus, scorching is to be avoided while the composition is subjected to thermal conditioning.

Regardless of where the thermal conditioning step occurs, the heated composition is delivered to a suitable applicator that spreads the composition along the length of the gravure cylinder. That spreading step may be effected by pouring or spraying the composition onto the gravure cylinder, or simply by delivering the liquid composition to a bath of composition that collects at the bottom of the gravure cylinder, between the gravure cylinder and a collector. The cylinder may be heated to prevent premature cooling of the composition.

Generally, the collector extends vertically around the gravure roller to a height sufficient to collect the bath, but to a height well below the top of the gravure cylinder. When the bath reaches the top of the collector, composition can flow through a drain at the bottom of the apparatus back into the reservoir. Thus, the composition circulates through the printing station and can be maintained at suitable printing viscosity by the thermal conditioning apparatus discussed above.

As the gravure cylinder rotates through the applicator and/or the bath, the composition adheres to the surface of the gravure cylinder, including in the impressions provided therein to define the patterned and/or banded regions. Further rotation of the gravure cylinder toward the nip moves the cylinder surface past a suitable doctor blade. The doctor blade extends along the length of the gravure cylinder and is positioned so that is wipes the surface of the gravure cylinder. In this way, those portions of the gravure cylinder that define the nominal spacing between adjacent patterned and/or banded regions is essentially wiped clean of the composition, while engraved portions of the gravure cylinder that define the patterned and/or banded regions themselves advance toward the nip full of the composition.

As the wrapper and the surface of the gravure cylinder move through the nip, the composition is transferred to the surface of the wrapper. The linear speed or velocity of the wrapper matches the tangential surface speed of both the gravure cylinder and the impression cylinder as the wrapper passes through the nip. In that way, slippage and/or smearing of the composition on the wrapper are avoided.

The thickness of the patterned and/or banded regions preferably is less than about 20% of the thickness of the base web, and may be less than 5% of the thickness of the base web. Thus, it is seen that the thickness of the printed layer is small in relation to the thickness of the underlying base web.

Figure 18:
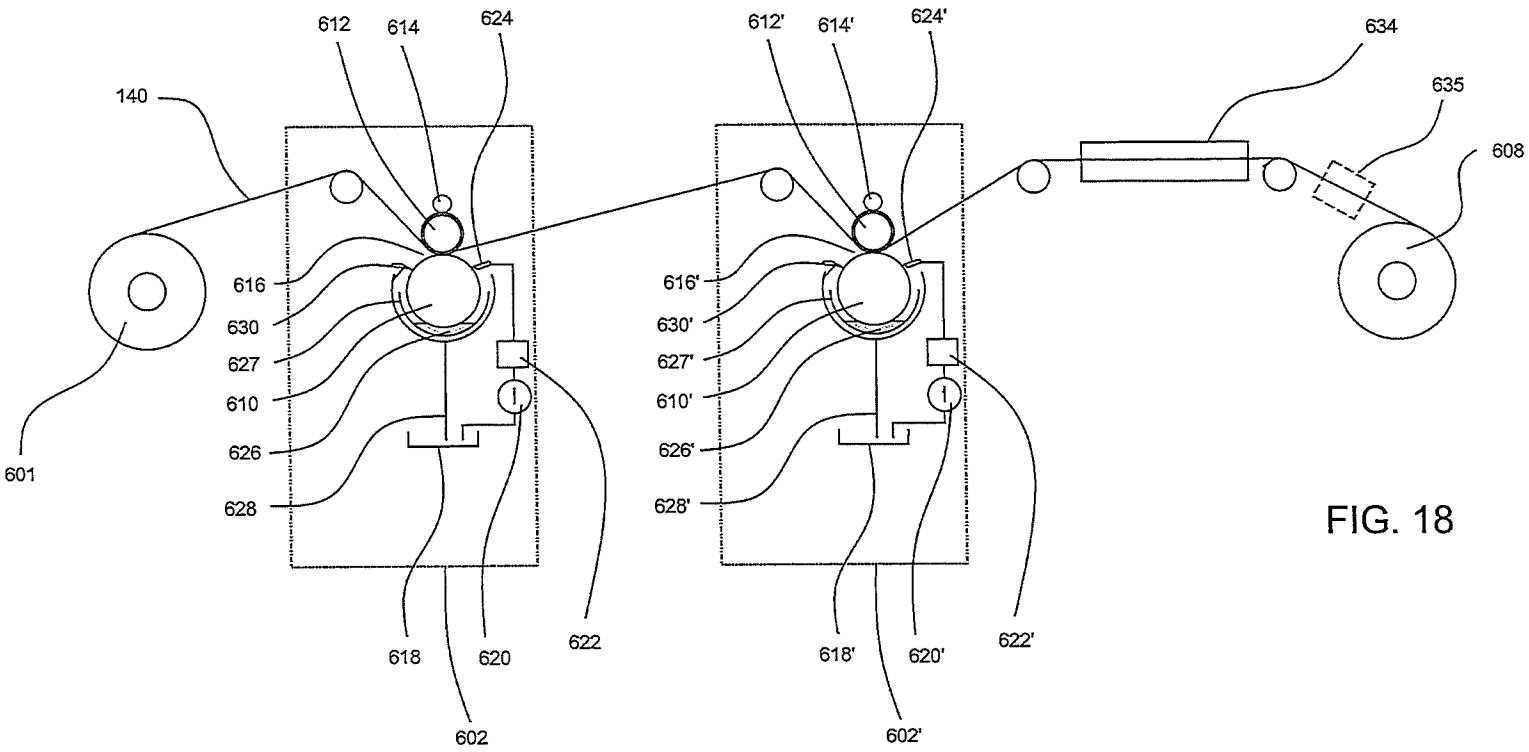
FIG. 18 is a schematic view of a gravure printing process suitable for producing embodiments of print banded wrapper as disclosed herein.

FIG. 18 is a schematic view of a printing apparatus. Two printing stages are depicted 602, 602'. Since the first printing stage 602 and the second printing stage 602' are substantially identical, it is not deemed necessary to repeat the description in detail for the second stage. Accordingly, corresponding features of the two stages have the same reference numeral, but the feature of the second stage is distinguished from the corresponding feature of the first stage by the addition of a prime (') to the corresponding reference numeral. It is to be understood that a single stage printing operation includes the first stage 602, while a two-stage printing operation includes the first stage 602 and the second stage 602'.

With reference to the above-description for printing, a supply reel 601 supplies a blank web of paper to a gravure printing station 602 where a pattern is printed on the blank web and dried in a drier 634. The dried, patterned base web then advances to a collection reel 608. If desired, a wide base web may be split or divided by a splitter 635 into a plurality of narrower bobbins after the printing operation, where the bobbins have a width corresponding to that required for a smoking article. The optional slitter 635 may be used on the base web as that base web leaves the printing station, or the slitter and slitting operation may be conducted at a different location. In the printing station 602, a gravure roller 610 contacts a reservoir 626 of add-on material, moves through a doctor blade 630 and contacts one side of the base web 140 in the nip 616 between the gravure roller 610 and an impression cylinder 612.

The add-on material is delivered from a reservoir 618 to the applicator 624 by a suitable pump 620. Add-on material discharged from the pump 620 preferably passes through a heat exchanger 622 where the temperature of the add-on material is elevated to the range of about 100° F. to about 140° F. The heated add-on material then flows to the applicator 624 where it is spread on the gravure roller 610. Excess add-on material accumulates in the bath 626 from which excess add-on material returns to the reservoir 618. The add-on material preferably has the characteristics described more fully above so that the appropriate amount of add-on material can be applied to the base web 140 during a single printing application.

In a single print station, single pass configuration, there may be, by way of example, approximately 34 engraved regions about the circumferential face of a gravure cylinder, each engraved region corresponding to a band to be applied to the web. Of those engraved regions, half would be engraved differently from the other half, with the two halves being interdigitated so that the differently engraved regions alternate around the circumference of the gravure cylinder. The engraving difference between the different regions may be effected by different widths (measured in the circumferential direction of the gravure cylinder) or depth of the engraved cells and/or geometric pattern of the engraved cells.

In an alternative embodiment, the circumferential outer surface of the gravure roller 610 may be constructed and arranged such that a first portion of that outer surface will print banded regions with a first pattern or design, and a second portion of that outer surface will print banded regions with a second pattern or design. The first portion may comprise about half of the surface area of the gravure roller 610, with the second portion then comprising about the other half of the surface area of that gravure roller 610. However, the relative proportions of the first portion and the second portion may vary quite substantially. For example, the first portion may be quite small relative to the second portion. The relative sizes of the first and second portions may be selected such that smoking articles subsequently manufactured with the wrapper have statistically desirable IP and SE characteristics.

Figure 19:
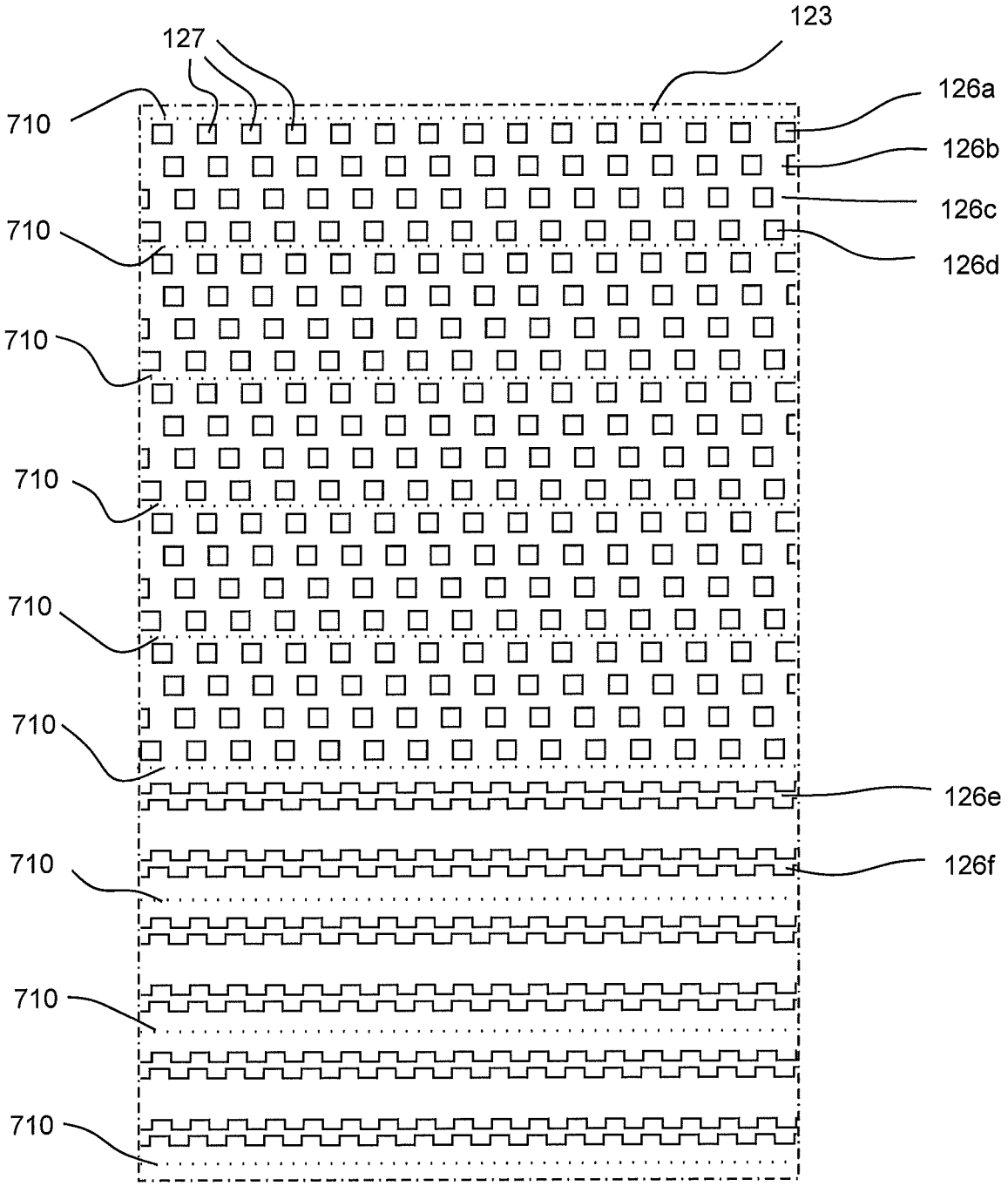
FIG. 19 is a schematic view of wrapper having alternating zones with different pattern elements in each zone.

More particularly, the IP and SE characteristics of different banded region patterns typically are different. By way of example, and without limitation, smoking articles fabricated with wrapper (see FIG. 19) having a patch pattern in the banded regions 126*a*, 126*b*, 126*c*, 126*d* may have SE performance of 31.1% and IP performance of 6.3%; whereas smoking articles fabricated with wrapper having a double saw tooth pattern in the banded regions 126*e*, 126*f* may exhibit SE performance of 57.5% and IP performance of 4.5%. By using a mixture of smoking articles where (i) about 72% of the smoking articles include two double saw tooth banded regions and (ii) about 28% of the smoking articles include four banded regions with a patch pattern, a sample population of about 200 smoking articles provide blended SE and IP characteristics which are a better compromise (through a weighted average) than either pattern taken by itself. Accordingly, it is possible to design smoking articles that not only comply with IP regulations, but which also satisfy smoker's desire for smoking articles that do not self-extinguish during free burn. Depending on the patterns used in the banded regions, and the statistical results of blending different patterns, various other area ratios may be used on the surface of the gravure roller.

By way of example (see FIG. 19), a portion of the base web 123 resulting from printing with such a gravure roller 610 may generate wrapper for a multiplicity of smoking articles. Spaces between the parallel dotted lines 710 (not actually present by illustrated for the purpose of reference and clarity) represent the length of a typical tobacco rod on the base web 123. In a first portion of the base web printed by the first portion of the gravure roller, transversely extending rows of patches 127 define banded regions 126*a*, 126*b*, 126*c*, 126*d*. The rows are preferably transversely offset from one another, and repeat their pattern every four rows along the longitudinal length of the base web 123. In a second portion of the base web printed by the second portion of the gravure roller, transversely extending double saw tooth patterns 126*e*, 126*f* are printed. The second pattern, i.e., the double saw tooth pattern, occurs twice between each pair of dotted lines representing the length of a typical tobacco rod. The gravure roller may be constructed such that about 28% of its surface prints the first pattern of patch banded regions, while about 72% of its surface prints the second pattern of double saw tooth patterns. A bobbin made from such a gravure roller will produce cigarettes according to that 28%/72% split between the two patterns (or any other split chosen by the cigarette designer. It is envisioned that a third pattern (or even more patterns) may be included.

If desired, the printing may also be effected in a two-stage arrangement where different materials are applied by separate printing stations 602, 602' so that dimensionally the banded regions are the same, but one has enhanced IP performance over the other, yet both are regulatory compliant. With two printing stations, the engraved regions could be positioned on two gravure cylinders 610, 610', each having, for example, 17 engraved regions. In such an arrangement, the two gravure cylinders 610, 610' may be identical, with the solution being applied being different in the two stations. Alternatively, the two stations or cylinders may apply the same solution (or composition) while the engraved regions of the two cylinders 610, 610' are different, i.e., circumferential width, and/or engraved cell configuration, and/or engraved cell pattern, and/or some combination of the foregoing possibilities. Where two such printing stations are used, a common base solution might be applied, but the chalk content could be different at the different stations, or the solutions might differ in their respective solids content, or their respective concentration levels of the film-forming agent, and/or their respective application rates.

Single Pass Printing Example

The following example of a solution used for single-pass printing of a patterned region on cigarette wrapper provides further foundation and background to explain the significance of the results now obtainable.

An aqueous starch solution was prepared by mixing Flow-Max 8, a tapioca-based oxidized starch available from National Starch with sufficient water to make an aqueous solution having an initial composition of 30% starch, by weight of solution. Then 1,2 propylene glycol and calcium carbonate were mixed or incorporated into the starch solution as additives. The weight of propylene glycol introduced was 25.7% of the weight of the starch used for the solution. The weight of the calcium carbonate introduced was 68.6% of the weight of the starch used for the solution.

The resulting printing solution was heated to a temperature in the range of about 100° F. to about 140° F. The final printing solution was applied as a pattern to a base web of cigarette wrapper having a nominal width of about 36 inches (i.e., about 920 mm) in a gravure printing press. The base web had a permeability of 60 CORESTA. The final printing solution was applied to the base web at a target rate of 33 to 41 BCM (billion cubic microns per square inch). The pattern for this example produced a plurality of parallel, solid bands extending across the nominal width of the base web, with each band having a width measured in the longitudinal direction of the base web of about 7 mm. Thereafter the base web was dried so that the printing solution dried.

Next, the base web was advanced under tension to a slitter where the nominal width of the base web was longitudinally cut into a plurality of strips, each strip having a width of about 27 mm—the width required to surround a conventional tobacco rod and have a longitudinal glue seam. While the base web was still under tension, the plurality of strips were simultaneously wound as individual bobbins.

Wrapper from the bobbins was used to manufacture a plurality of cigarettes using conventional cigarette-making machinery.

The resulting cigarettes were tested for IP performance using the standard technique discussed above. Using the standard complement of cigarettes, cigarettes manufactured in this example gave IP performance of 0 in each of several IP tests.

Based on this example, as well as other studies, a better understanding of the mechanisms that give rise to manufacturability of print banded paper using aqueous starch printing solutions continues to evolve. Certain background information is helpful to place the significance of the present invention in context. Initially, it should be noted that aqueous starch solutions for patterned regions appear to overcome reported seam bursting problems that have been associated with use of, e.g., alginate-based solutions, in part because starch-based adhesives typically have been used for the longitudinal seam of a tobacco rod.

Potential wrinkling in the base web when aqueous-based printing solutions were used has been an area of concern. The wrinkling situation seems to result from use of aqueous printing solution having a low solids content. A low solids content appears to result in large amounts of water being available to interfere with the hydrogen bonding between fibers in the base web. When the base web is dried after printing, shrinkage occurs. Because the base web is under continual longitudinal tension, shrinkage in the longitudinal direction does not appear to be significant or troublesome, but shrinkage in the cross-web direction is both significant and troublesome. It is well known and documented that wetting and drying paper after its production gives rise to shrinkage. Thus, some shrinkage is to be expected from this process.

Without the use of an anti-wrinkling agent, the cross-web shrinkage has been observed to be as much as one inch in a 36 inch wide web—i.e., on the order of 2.8%. Tension in the base web as the base web moves from the printing apparatus to the slitter and the bobbin winder, in the presence of cross-web shrinkage, gives rise to longitudinally extending waves in the base web between printed regions. As the base web passes over rollers between the printing apparatus and the bobbin winder, those waves can be pressed down to form creases. Once a crease forms, experience shows that it tends to continue for significant distances along the web.

At the slitter, the waves and creases cause a lack of precise location for the cut in the longitudinal direction with the result that, at the bobbin winder, paper edges of one bobbin can get wound into an adjacent bobbin so that subsequent separation of the adjacent bobbins becomes difficult or impossible.

The use of multiple printing stations to apply a sequence of registered applications of an aqueous printing solution has been observed to make the shrinkage, waviness, creasing, and slitting issues more pronounced.

While not wishing to be bound by these theories, shrinkage seems to result when unbounded or free water penetrates the base web, causing fibers to swell, breaking hydrogen bonds between fibers, allowing fiber movement, and shrinking during the drying process. For purposes of this discussion, bounded water refers to the quantity of water needed to associate with additives. For example, water is needed to dissolve starch, so there is bound water in an equivalent weight to the weight of starch. Similarly, propylene glycol is soluble in water, so it is assumed that there is bound water in an equivalent weight to the weight of propylene glycol. However, calcium carbonate is not meaningfully soluble in water, so no bound water is associated with calcium carbonate. Unbound, or free, water refers to the quantity or portion of water in excess of that needed for solubility of additives. It is believed that this unbounded or free water is operable to penetrate the base web and affect the fibers therein; while the bound water does not have that effect.

Existing multi-pass printing processes using aqueous solutions have low starch concentrations, e.g., about 15% to 25% starch. Such aqueous starch solutions have 85% to 75% water, respectively, with 15 to 25% being water bound to the starch, and 70% to 50%, respectively, being unbounded or free water. In contrast, a solution having the constituency described in the foregoing example at the time of printing has total water of about 52%, bounded water of about 31%, and unbounded water of about 21%. Thus, the solution of the preceding example, when compared to an equivalent amount of an aqueous starch solution, exhibits a reduction in unbounded water of more than about 50% (i.e., 21% compared to 50 to 70%).

Certainly, the application rate of printing solution to the underlying web can also have an effect on the penetration of free water into the base web. As noted, the single-pass printing process described in the preceding example applies the final printing solution at a target rate of 33 to 41 BCM. By contrast, a multiple pass printing operation may, for example, deposit layers at 3×, 3.5×, and 5×. From the table of equivalents set out above, those application rates correspond to 12.3 BCM, 13.6 BCM, and 22.4 BCM, respectively, or a total of about 48.3 BCM. Thus, a single printing pass process reduces the amount of printing solution used in comparison to a typical multiple-pass system—even though the application rate for a single pass is greater than the application rate for any of the component passes of a typical multiple-pass system.

To briefly summarize, the single-pass printing process appears to reduce the free water available to penetrate the base web when compared to a typical multiple-pass process as the result of two phenomena: the single-pass process tends to use less total water in the applied printing solution than does the multiple-pass process; and the composition of the printing solution in single-pass system presents much less free water to penetrate the base web than does the typical multiple-pass process. There is an advantage in both reducing the amount of unbounded water and counteracting the unbounded water with an anti-wrinkling agent.

It should also be noted that the single-pass process with the printing compositions described herein provides a high solids content deposition that not only reduces the free water available for disruption of the underlying paper web but also provides the solid content appropriate for the observed IP performance.

It has also been found that while some shrinkage can be accommodated, a critical value for acceptable shrinkage in the printing process exists. Above that critical value, creasing of the base web occurs downstream of the printing operation as discussed above in more detail; however, below that critical value, the single-pass process of this invention results in wrinkle-free, crease-free paper that can be slit and wound on bobbins. The critical value for acceptable shrinkage has been found to be about 1% of the nominal width of the base web. Using the printing solution described in the preceding example, the web shrinkage was found to be about 0.54% of the nominal width of the base web.

Based on the present understanding, the aqueous printing solution for the single-pass process, preferably includes 25% or more starch mixed in water with about 30 to about 80% chalk or calcium carbonate being added, where chalk content is expressed as a percentage of starch weight, and further including an effective amount of an anti-wrinkling agent, such as 1,2 propylene glycol. The effective amount of the anti-wrinkling agent corresponds to the amount needed to reduce the shrinkage at the printed pattern on the web to less than about 1% of the nominal width of the web. Stated differently, with the effective amount of the anti-wrinkling agent, the nominal width of the base web is reduced by less than about 1% at the pattern location. Alternatively, the printing solution includes an anti-wrinkling agent between about 20% and about 35% of the starch weight.

The presently preferred composition of the aqueous printing solution can also be expressed in weight percentages. More specifically, the aqueous solution preferably includes 25% (by weight) or more starch, calcium carbonate in the range of about 5% to about 30%, by weight, and an anti-wrinkling agent such as 1,2 propylene glycol in amount less than about 30%, by weight. Further, the calcium carbonate is more preferably present in the range of about 5% to about 20% by weight.

With respect to the composition of the printing solution, the increased starch concentration in the aqueous solution, as contrasted with prior aqueous solutions, appears to enhance the film-forming capabilities of the printing solution when applied to a base web. Having better film-forming functionality, less calcium carbonate is needed since there are fewer pin-holes in the base web that need to be filled or plugged.

The single-pass capability reduces registration requirements and promotes other efficiencies during printing.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

The terms and phases used herein are not to be interpreted with mathematical or geometric precision, rather geometric terminology is to be interpreted as meaning approximating or similar to the geometric terms and concepts. Terms such as "generally" and "substantially" are intended to encompass both precise meanings of the associated terms and concepts as well as to provide reasonable latitude which is consistent with form, function, and/or meaning.

It will now be apparent to those skilled in the art that this specification describes a new, useful, and nonobvious smoking article, wrapper therefor, and process for making the wrapper and smoking article. It will also be apparent to those skilled in the art that numerous modifications, variations, substitutes, and equivalents exist for various aspects of the smoking article, wrapper and process that have been described in the detailed description above. Accordingly, it is expressly intended that all such modifications, variations, substitutions, and equivalents that fall within the spirit and scope of the invention, as defined by the appended claims, be embraced thereby.

What is claimed is:

1. A smoking article, comprising:

a quantity of tobacco;

a wrapper paper surrounding the quantity of tobacco and defining a tobacco rod having a first end and a second end;

the wrapper paper including a first pattern of add-on material having a width extending between the first and second ends of the tobacco rod and a second pattern of add-on material having a width extending between the first and second ends of the tobacco rod wherein the first pattern of add-on material is axially spaced from the second pattern of add-on material by a distance greater than the width of the first pattern of add-on material or the width of the second pattern of add-on material;

the add-on material of the first pattern of add-on material is identical to the add-on material of the second pattern of add-on material, each containing starch, chalk, and an anti-wrinkling agent;

wherein the first pattern of add-on material forms a first banded region of the smoking article having a first IP performance and the second pattern of add-on material forms a second banded region of the smoking article having a second IP performance wherein the first IP performance is different than the second IP performance, the first banded region is axially spaced from the second banded region along the length of the tobacco rod by about 12 to 40 mm such that an area between the first and second banded regions does not include any add-on material along the axial spacing thereof to allow free burn of the smoking article between the first and second banded regions and the first and second patterns of add-on material have different geometrical patterns.

2. The smoking article of claim 1, wherein a filter is attached to the first end of the tobacco rod.

3. The smoking article of claim 1, wherein the anti-wrinkling agent is propylene glycol.

4. The smoking article of claim 1, wherein the add-on material of the first and second patterns of add-on material have been applied to the wrapper paper by a gravure printing step.

5. The smoking article of claim 1, wherein the first banded region and/or the second banded region includes at least first and second zones of add-on material and a circumferentially extending discontinuity free of add-on material separating the first and second zones by about 1 to 2 mm.

6. The smoking article of claim 5, wherein the first banded region and the second banded region each include the circumferentially extending discontinuity wherein the respective circumferentially extending discontinuities are spaced about 27 mm apart.

7. The smoking article of claim 1, wherein the first banded region and/or the second banded region includes at least first, second, and third zones of add-on material and a first circumferentially extending discontinuity free of add-on material separating the first and second zones by about 1 to 2 mm, and a second circumferentially extending discontinuity free of add-on material separating the second and third zones by about 1 to 2 mm.

8. The smoking article of claim 1, wherein the wrapper paper has a CORESTA permeability of about 60.

9. The smoking article of claim 1, wherein:

(a) the first IP performance is 0% and the second IP performance is less than 25%;

(b) the first IP performance in combination with the second IP performance is less than 25%;

(c) the first IP performance is less than 25% and the second IP performance is less than 25%;

(d) the first IP performance is less than 15% and the second IP performance is less than 15%;

(e) the first IP performance is less than 10% and the second IP performance is less than 10%;

(f) the first IP performance is less than the second IP performance; or (g) the second IP performance is less than the first IP performance.

10. The smoking article of claim 1, wherein:

(a) the smoking article has an SE average value of less than 50%;

(b) the smoking article has an SE average value of less than 25%; or (c) the smoking article has an SE average value of less than 10%.

11. The smoking article of claim 1, wherein the first pattern of add-on material and the second pattern of add-on material are each formed of a single layer of add-on material.

12. The smoking article of claim 1, wherein discrete portions of the first and/or second banded regions have differing thicknesses.

* * * * *